US008727324B2

(12) United States Patent
Borden et al.

(10) Patent No.: US 8,727,324 B2
(45) Date of Patent: May 20, 2014

(54) WINE AERATOR

(75) Inventors: Michael Borden, Las Vegas, NV (US); Sean O'Cuinneagain, Lutz, FL (US)

(73) Assignee: Prime Wine Products LLC, Tampa, FL (US)

( * ) Notice: Subject to any disclaimer, the term of this patent is extended or adjusted under 35 U.S.C. 154(b) by 327 days.

(21) Appl. No.: 13/310,642

(22) Filed: Dec. 2, 2011

(65) Prior Publication Data

US 2013/0140721 A1 Jun. 6, 2013

(51) Int. Cl.
*B01F 3/04* (2006.01)

(52) U.S. Cl.
USPC ..... 261/76; 261/116; 99/323.1; 426/474; 222/190

(58) Field of Classification Search
CPC ..... B01F 3/04; B01F 3/04099; B01F 3/04787
USPC ..... 261/76, 78.2, 116, DIG. 75; 99/323.1; 222/190; 426/474
See application file for complete search history.

(56) References Cited

U.S. PATENT DOCUMENTS

| | | | |
|---|---|---|---|
| D154,935 | S | 8/1949 | Lilja |
| D210,743 | S | 4/1968 | Chaffee |
| 3,704,008 | A | 11/1972 | Ziegler |
| 3,774,645 | A | 11/1973 | Pompa |
| D229,918 | S | 1/1974 | Schlessel |
| 4,308,138 | A | 12/1981 | Woltman |
| 4,564,480 | A | 1/1986 | Kamelmacher |
| 4,595,121 | A | 6/1986 | Schultz |
| 4,640,782 | A | 2/1987 | Burleson |
| 4,721,562 | A | 1/1988 | Barnscheidt et al. |
| 5,169,293 | A | 12/1992 | Yamamoto |
| 5,293,912 | A | 3/1994 | Wildash et al. |
| 5,335,588 | A | 8/1994 | Mahlich |
| 5,336,402 | A | 8/1994 | Yamamoto et al. |
| 5,403,475 | A | 4/1995 | Allen |
| 5,509,349 | A | 4/1996 | Anderson et al. |

(Continued)

FOREIGN PATENT DOCUMENTS

| | | |
|---|---|---|
| EP | 0344859 | 12/1989 |
| JP | 56-017625 | 2/1981 |
| JP | 10-033961 | 2/1998 |
| JP | 2004-122043 | 4/2004 |

OTHER PUBLICATIONS

Supplemental European Search Report, Serial No. 07749822, Mar. 2009.

(Continued)

*Primary Examiner* — Robert A Hopkins
(74) *Attorney, Agent, or Firm* — Knobbe Martens Olson & Bear, LLP

(57) ABSTRACT

A device for aerating a liquid, such as wine, includes a cup portion with a cavity that receives an amount of liquid therein, the cavity extending between a proximal opening and a distal opening. A neck portion of the device defines an aeration section in fluid communication with the cavity. Passages in the aeration section extend laterally to an outer surface of the neck portion through which air is drawn into the aeration section. A central passage through the neck portion is in fluid communication with the aeration section and extends to a distal opening of the device. A diffuser element between the cavity and the aeration section has arms that are configured to contact the liquid as it flows from the cavity to inhibit a swirling flow of the liquid so that the liquid passes into the aeration section in a generally vertical and linear manner.

21 Claims, 28 Drawing Sheets

(56) References Cited

U.S. PATENT DOCUMENTS

| | | | |
|---|---|---|---|
| 5,568,660 | A | 10/1996 | Raburn et al. |
| 5,923,912 | A | 7/1999 | Miki et al. |
| D425,785 | S | 5/2000 | Hirato et al. |
| 6,162,021 | A | 12/2000 | Sarshar et al. |
| 6,290,917 | B1 | 9/2001 | Yamamoto |
| 6,450,484 | B1 | 9/2002 | Popov |
| D474,689 | S | 5/2003 | Oinsky |
| 6,568,660 | B1 | 5/2003 | Flanbaum |
| 6,581,856 | B1 | 6/2003 | Srinath |
| 6,767,006 | B1 | 7/2004 | Tripepi |
| 6,986,506 | B2 | 1/2006 | Chapman et al. |
| D535,559 | S | 1/2007 | Kehoe |
| 7,299,743 | B2 | 11/2007 | Moore |
| D604,560 | S | 11/2009 | Priest |
| 7,614,614 | B2 | 11/2009 | Sabadicci et al. |
| D610,915 | S | 3/2010 | Conway et al. |
| D612,659 | S | 3/2010 | Kehoe |
| D614,443 | S | 4/2010 | Federighi |
| D624,355 | S | 9/2010 | Tiso |
| D624,358 | S | 9/2010 | Maufette et al. |
| 7,841,584 | B2 | 11/2010 | Sabadicci et al. |
| D640,904 | S | 7/2011 | Wax |
| D642,018 | S | 7/2011 | Zamarripa et al. |
| 7,992,844 | B2 | 8/2011 | Chiorazzi |
| D652,251 | S | 1/2012 | Goralski et al. |
| D663,172 | S | 7/2012 | Huynh |
| 2004/0166000 | A1 | 8/2004 | Fisher et al. |
| 2004/0251566 | A1 | 12/2004 | Kozyuk |
| 2005/0205609 | A1 | 9/2005 | Moore |
| 2007/0128387 | A1 | 6/2007 | Unwin et al. |
| 2009/0160072 | A1 | 6/2009 | Chiorazzi |
| 2010/0006603 | A1 | 1/2010 | Weinberg et al. |
| 2010/0011967 | A1 | 1/2010 | Barberio et al. |
| 2010/0025867 | A1 | 2/2010 | Benton et al. |
| 2010/0058933 | A1 | 3/2010 | Cheng |
| 2010/0091605 | A1 | 4/2010 | Rasmussen et al. |
| 2010/0122919 | A1 | 5/2010 | Burroughs et al. |
| 2011/0024461 | A1 | 2/2011 | Kilduff et al. |
| 2011/0024925 | A1 | 2/2011 | Mauffette |
| 2011/0042835 | A1 | 2/2011 | Sabadicci et al. |
| 2011/0154994 | A1 | 6/2011 | Sabadicci |
| 2011/0271846 | A1 | 11/2011 | Hynes |
| 2011/0274805 | A1 | 11/2011 | Nudi, Jr. et al. |

OTHER PUBLICATIONS

Winemag.us, The New General Wine Aerator, Wine Review Magazine, http://www.winemag.us/wine/the-new-generation-wine-aerator.html, Dec. 7, 2008.

Notice of Allowance mailed on Jul. 18, 2012 in U.S. Appl. No. 29/408,577.

Respirer wine aerator, available more than one year before Dec. 2, 2011, accessed on Oct. 18, 2012 at http://www.drinkdrycreek.com/?p=761.

Vin-aire wine aerator, available more than one year before Dec. 2, 2011, accessed on Oct. 18, 2012 at http://www.vin-aire.com/.

WINE AERATOR

BACKGROUND

1. Field

The present application relates to an aerator device for fluids, and more particularly, to a wine aerator.

2. Description of the Related Art

One way to improve the wine drinking experience is to aerate the wine to maximize the wine's exposure to surrounding air. Mixing the wine with air allows the wine to warm up, the wine's aromas to open up and the overall flavor characteristics to improve.

Various methods and devices for aerating wine exist. Some include devices into which wine is poured and that draws air into the flow of wine that flows through the device. One disadvantage with such devices is that as wine flows though the device, it has a tendency to swirl, especially when the volume of wine flowing through the device decreases. Such a swirling flow provides for inadequate aeration of wine.

Accordingly, there is a need for an improved wine aerator that addresses the deficiencies present in existing wine aerators.

SUMMARY

In accordance with one embodiment, a device for aerating wine is provided. The device comprises a one-piece body that comprises a cup portion having a cavity configured to receive an amount of wine therein, the cavity extending between a proximal opening at a proximal end of the cup portion and a distal opening at a distal section of the cavity. The body also comprises a neck portion that defines an aeration section therein that is in fluid communication with the distal section of the cavity, the aeration section having one or more passages that extend laterally from the aeration section to an outer surface of the neck portion through which air is drawn into the aeration section. The body further comprises an end portion, the neck and end portion defining a central passage in fluid communication with the aeration section and extending to a distal opening at a distal end of the body, the passage increasing in diameter between the aeration section and a distal end of the body. The device also comprises a diffuser element disposed in the distal section of the cavity and shaped to allow flow therethrough from the cavity to the aeration section, the diffuser element having one or more arms that extend into the cavity, the arms configured to contact the amount of wine as it flows from the cavity and to inhibit a swirling flow of the wine so that the wine passes into the aeration section in a generally vertical and linear manner.

In accordance with another embodiment, a device for aerating a liquid is provided. The device comprises a one-piece body that comprises a cup portion having a cavity configured to receive an amount of liquid therein, the cavity extending between a proximal opening at a proximal end of the cup portion and a distal opening at a distal section of the cavity. The body also comprises a neck portion that defines an aeration section therein that is in fluid communication with the distal section of the cavity, the aeration section having one or more passages that extend laterally from the aeration section to an outer surface of the neck portion through which air is drawn into the aeration section. The body further comprises an end portion, the neck and end portion defining a conical passage in fluid communication with the aeration section and extending to a distal opening at a distal end of the body, the passage increasing in diameter between the aeration section and a distal end of the body. The device also comprises a diffuser element disposed in the distal section of the cavity and shaped to allow flow therethrough from the cavity to the aeration section, the diffuser element having a plurality of arms that extend into the cavity and form a cross shape, the arms configured to contact the amount of liquid as it flows from the cavity and to inhibit a swirling flow of the liquid so that the liquid passes into the aeration section in a generally vertical and linear manner.

BRIEF DESCRIPTION OF THE DRAWINGS

FIG. 3A-1 is an exploded sectional view of a portion of the schematic cross-sectional side view of the aerator device shown in FIG. 3A.

FIG. 7C-1 is an exploded sectional view of a portion of the schematic cross-sectional side view of the aerator device shown in FIG. 7C.

FIG. 9C-1 is an exploded sectional view of a portion of the schematic cross-sectional side view of the aerator device shown in FIG. 9C.

DETAILED DESCRIPTION

Figure 1:
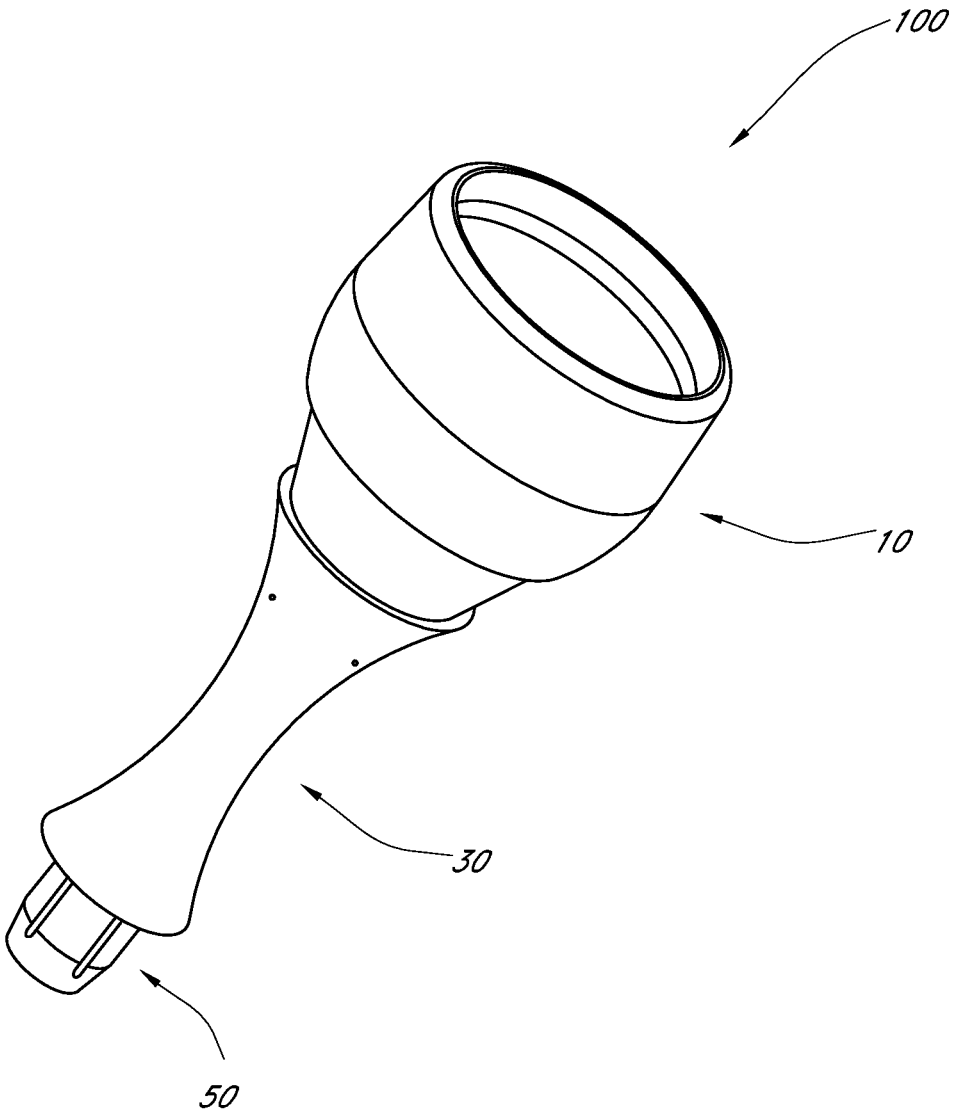
FIG. 1 is a schematic perspective top view of one embodiment of an aerator device.

FIG. 1 shows one embodiment of an aerator device 100 for aerating fluids, such as wine. The aerator device 100 can include a cup portion 10 at its proximal end, a neck portion 30 attached to the cup portion 10, and an end portion 50 at a distal end of the aerator device 100.

With reference to FIGS. 2A-5, the aerator device 10 can extend from a proximal end P to a distal end D. The cup portion 10 can have a wall 12 that defines an opening 12*a* at the proximal end P and an inner surface 12*b* that defines a cavity 14 into which a fluid (e.g., wine) can be poured, as well as a fill line 14*a* in the cavity 14 that a user can use to determine how much liquid to pour into the cup portion 10. In the illustrated embodiment, the inner surface 12*b* has a curved shape similar to that of a wine glass. The wall 12 of the cup portion 10 also defines a curved outer wall 12*c* and a recessed section 12*d* distal of the curved outer wall 12*c*. The recessed section 12*d* is sized to receive a band 300 therein, as described further below. The opening 12*a* can have diameter of between about 1.5 inches and about 3 inches. In one embodiment, the opening 12*a* can have a diameter of about 2 inches. The inner surface 12*b* can have a curvature defined by a radius of curvature of between about 1 inch and about 2 inches. In one embodiment, the inner surface 12*b* can have a curvature defined by a radius of curvature of about 1.5 inches.

Figure 2A:
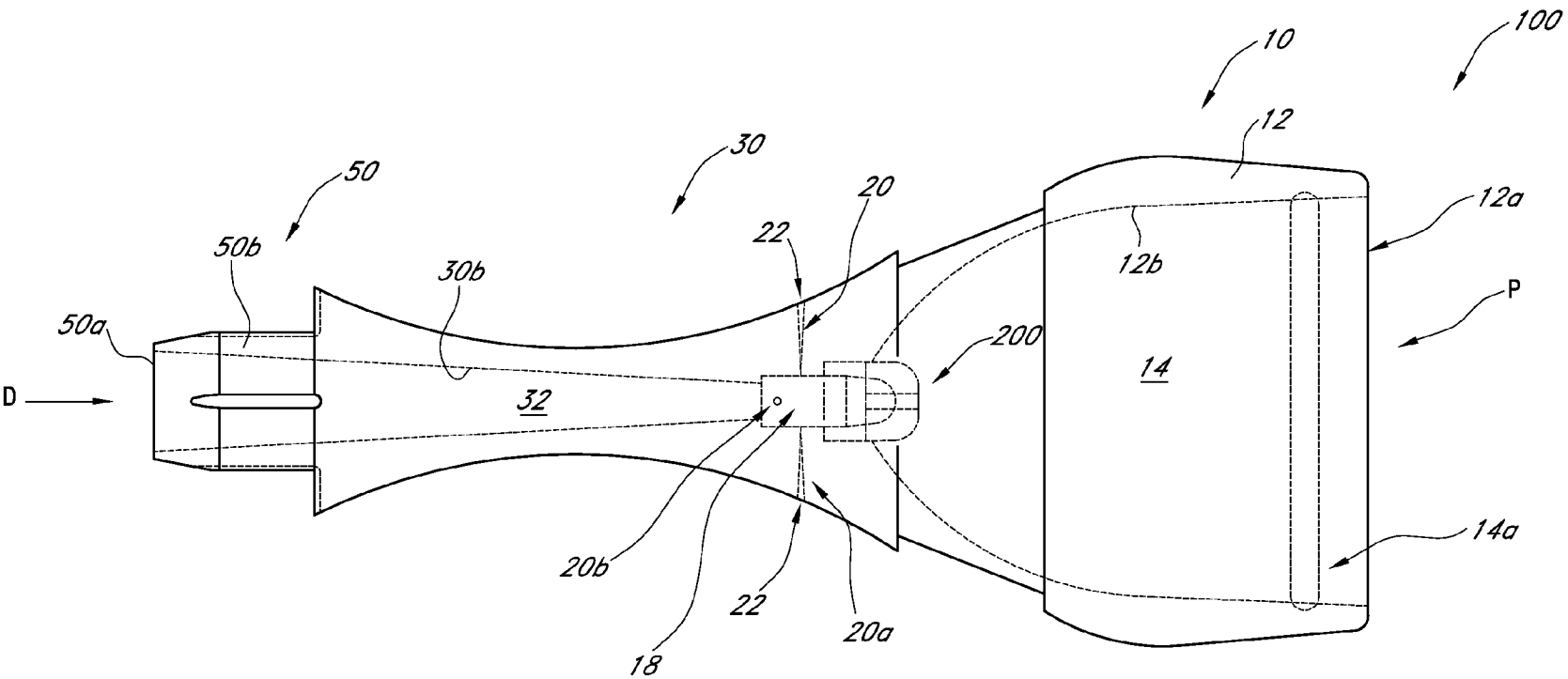
FIG. 2A is a schematic side view of the assembled aerator device of FIG. 1.
Figure 2B:
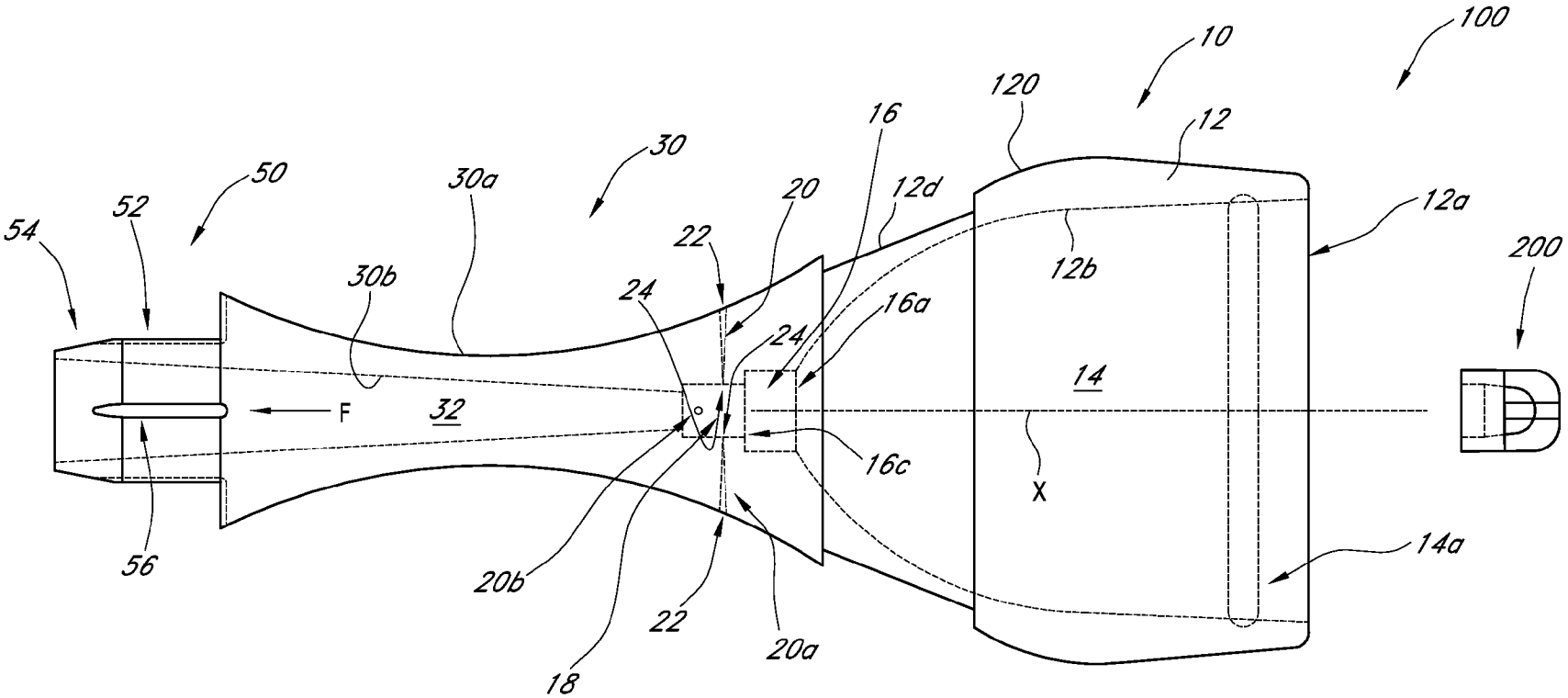
FIG. 2B is a schematic exploded side view of the aerator device of FIG. 1.

The inner surface 12*b* extends between the opening 12*a* at the proximal end P and an opening 16*a* that fluidly communicates the cavity 14 with a first chamber 16 that is distal of the cavity 14. In the illustrated embodiment, the first chamber 16 is defined within the neck portion 30 and is generally cylindrical in shape. In one embodiment the first chamber 16 can have a diameter 16*d* of between about 0.3 and 0.5 inches and has a length 16*b* of between about 0.15 an 0.4 inches. In another embodiment, the first chamber 16 can have a diameter 16*d* of about 0.4 inches and a length 16*b* of about 0.25 inches. However, other suitable values are possible for the diameter 16*d* and length 16*b*, and in other embodiments the first chamber 16 can have shapes other than cylindrical (e.g., cubic). As shown in FIG. 2A-2B, the first chamber 16 is sized to receive a diffuser element 200 therein, which is further described below.

The first chamber 16 has a distal opening 16*c* that fluidly communicates the first chamber 16 with an aeration chamber 18 that is distal of the first chamber 16. In the illustrated embodiment, the aeration chamber 18 is defined within the neck portion 30 and is generally cylindrical in shape. In one embodiment the aeration chamber 18 can have a diameter 18*d* of between about 0.2 and 0.4 inches and has a length 16*b* of between about 0.2 an 0.5 inches. In another embodiment, the aeration chamber 18 can have a diameter 18*d* of about 0.25 inches and a length 18*b* of about 0.3 inches. In the illustrated embodiment, the diameter 18*d* of the aeration chamber 18 is smaller than the diameter 16*d* of the first chamber 16. However, other suitable values are possible for the diameter 18*d* and length 18*b*, and in other embodiments the aeration chamber 18 can have shapes other than cylindrical (e.g., cubic).

With continued reference to FIGS. 2A-5, the aerator device 100 can have one or more passages 20 that extend from an outer surface 30*a* of the neck portion 30 to the aeration chamber 18 and fluidly communicate the aeration chamber 18 with the outside of the aerator device 100. In the illustrated embodiment, the aerator device 100 has four passages 20 disposed generally at 90° relative to each other, with each two of the passages 20 disposed on opposite sides of the aeration chamber 18 from each other. In the illustrated embodiment, one pair of passages 20*a* are disposed opposite each other in the aeration chamber 18, and a second pair of passages 20*b* (shown normal to the page) are disposed opposite to each other in the aeration chamber 18. As shown, for example, in FIG. 2B, the passages 20*b* are located on a plane downstream of a plane on which the passages 20*a* are located, so that the aeration chamber 18 has four passages 20 with two passages 20*a* in a proximal section of the chamber 18 and two passages 20*b* in a distal section of the chamber 18. The offset passages 20 advantageously provides for improved aeration of the fluid as it passes through the aeration chamber 18. In one embodiment, the passages 20*a* can be located about halfway along the length of the aeration chamber 18. However, in other embodiments, the aerator device 100 can have fewer or more passages. The passages 20 extend from an outer opening 22 on the outer surface 30*a* of the neck portion 30 to an inner opening 24 on a surface of the aeration chamber 18. In the illustrated embodiment, the passages 20 extend generally perpendicular to a longitudinal axis (e.g., axis of symmetry) X of the aerator device 100. In another embodiment, the passages 20 can extend at a non-perpendicular angle relative to the longitudinal axis X of the aerator device 100. As shown, for example, in FIG. 2B-3A, the passages 20 can be conical and extend from a narrow end at the inner opening 24 to a wide end at the outer opening 22. In one embodiment, the inner opening 24 can have a diameter 24*a* of between about 0.005 and 0.020 inches and the outer opening 22 can have a diameter 22*a* of between about 0.02 and 0.04 inches.

The aeration chamber 18 can have a distal opening 18*a* that fluidly communicates the aeration chamber 18 with a passage 32 that is distal of the aeration chamber 18. In the illustrated embodiment, the passage 32 is defined by a surface 30*b* within the neck and end portions 30, 50 and is generally frustoconical in shape. In one embodiment, the distal opening 18*a*, which corresponds to the proximal end of the passage 32, can have a diameter 32*a* of between about 0.1 and 0.2 inches. In another embodiment, the distal opening 18*a* can have a diameter 32*a* of about 0.18 inches. The passage 32 can also have a distal opening 50*a* at the distal end D of the aerator device 100 with a diameter 32*b* of between about 0.3 and 0.5 inches, where the diameter 32*b* of the distal opening 50*a* is greater than the diameter 32*a*. In another embodiment, the distal opening 32*b* can have a diameter of about 0.45 inches. In the illustrated embodiment, the diameter 32*a* is smaller than the diameter 18*d* of the aeration chamber 18. However, other suitable values are possible for the diameter 32*a*, and in other embodiments the passage 32 can have shapes other than frustoconical (e.g., cylindrical).

With reference to FIG. 2B, the end portion 50 of the aerator device 100 can have a generally cylindrical portion 52 and a tapered portion 54 that extends from the cylindrical portion 52 to the distal end D of the aerator device 100. The end portion 50 can also have one or more channels 56 formed on an outer surface 50*b* thereof. In the illustrated embodiment, the aerator device 100 has four channels 56 distributed about the circumference of the end portion 50. However, in other embodiments, the aerator device 100 can have fewer or more channels about the circumference of the end portion 50.

Figure 3A:
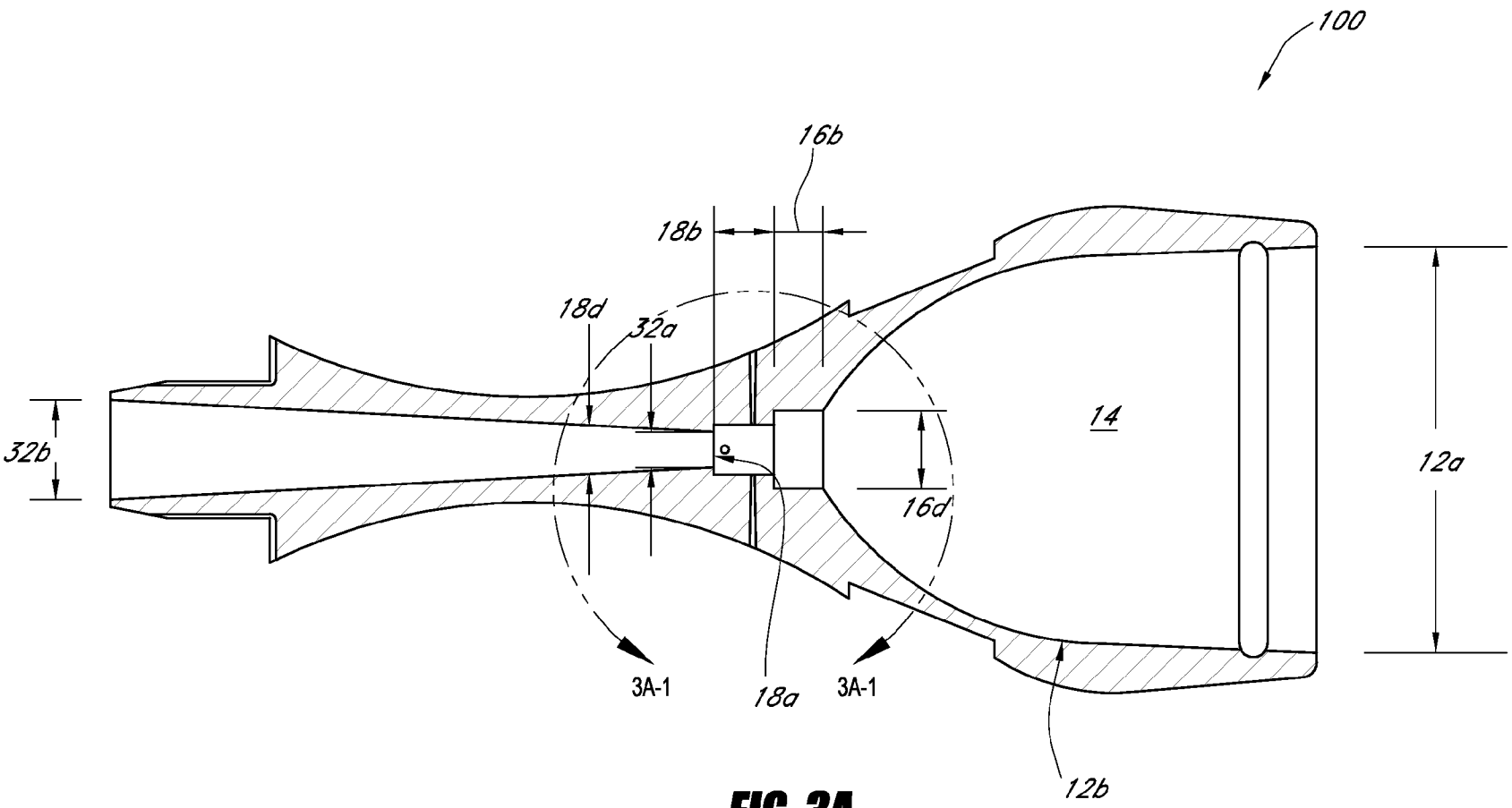
FIG. 3A is a schematic cross-sectional side view of the aerator device of FIG. 1 without the diffuser element.
Figures 1, 3A:
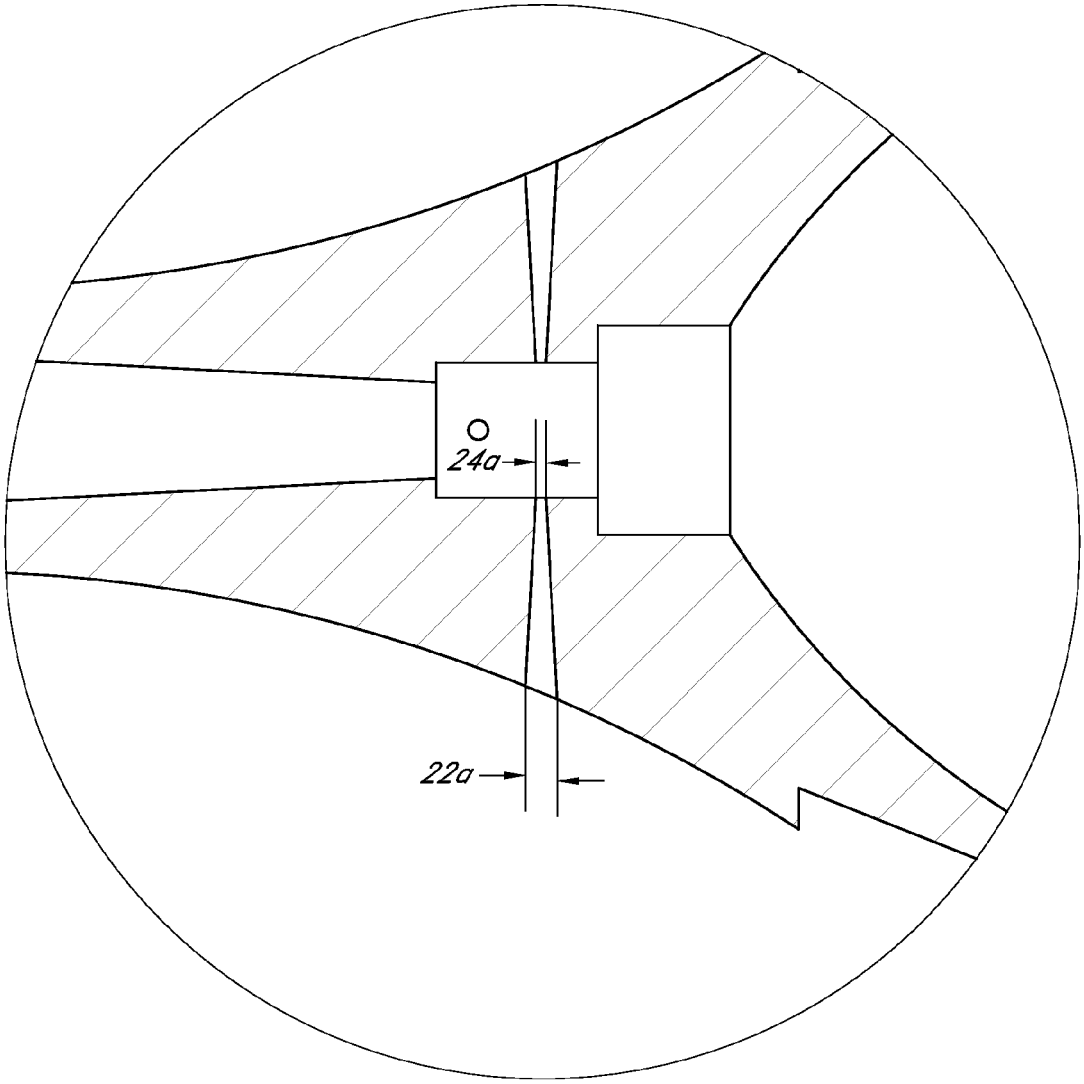
Figure 3B:
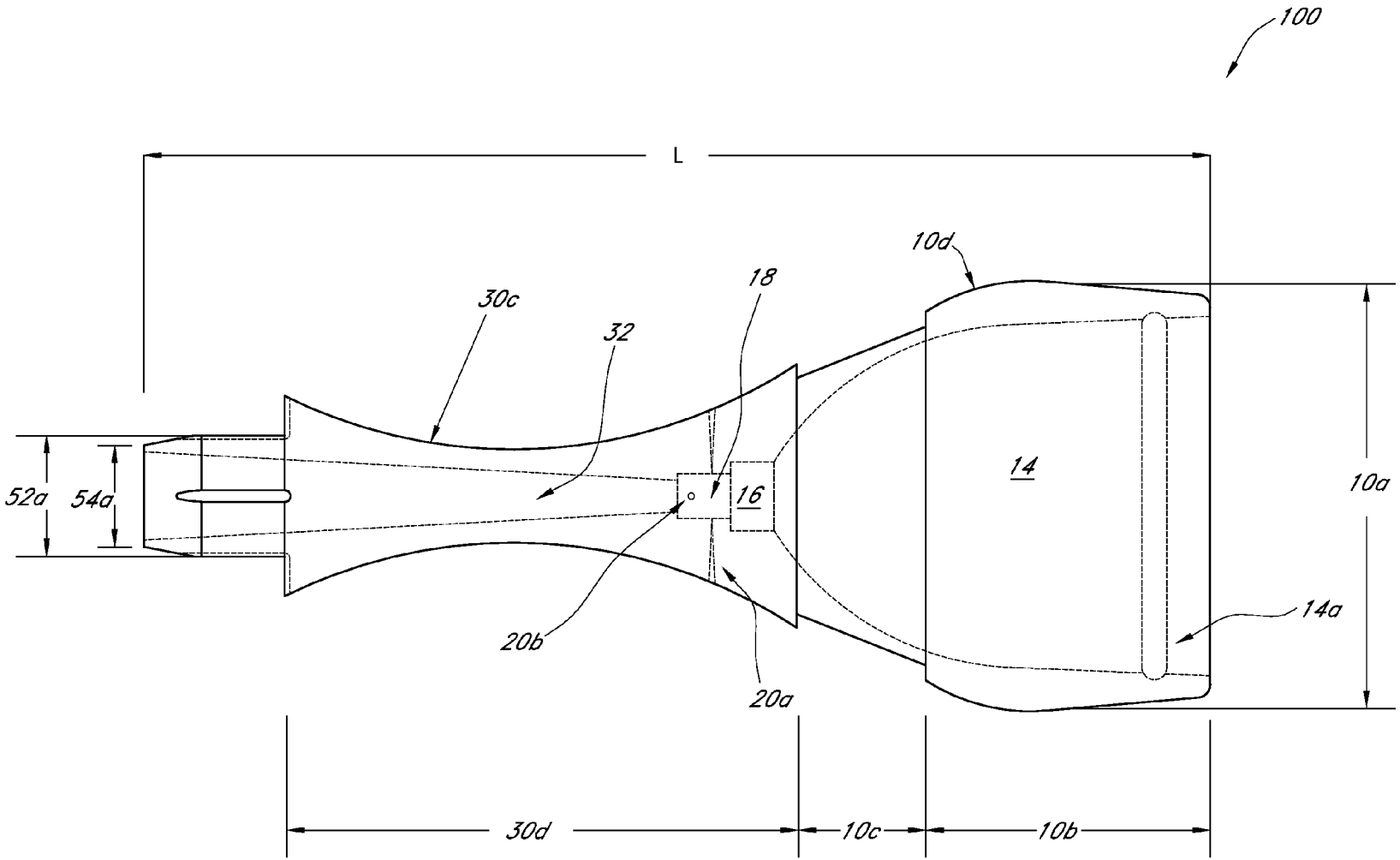
FIG. 3B is a schematic side view of the aerator device of FIG. 1 without the diffuser element.
Figure 5:
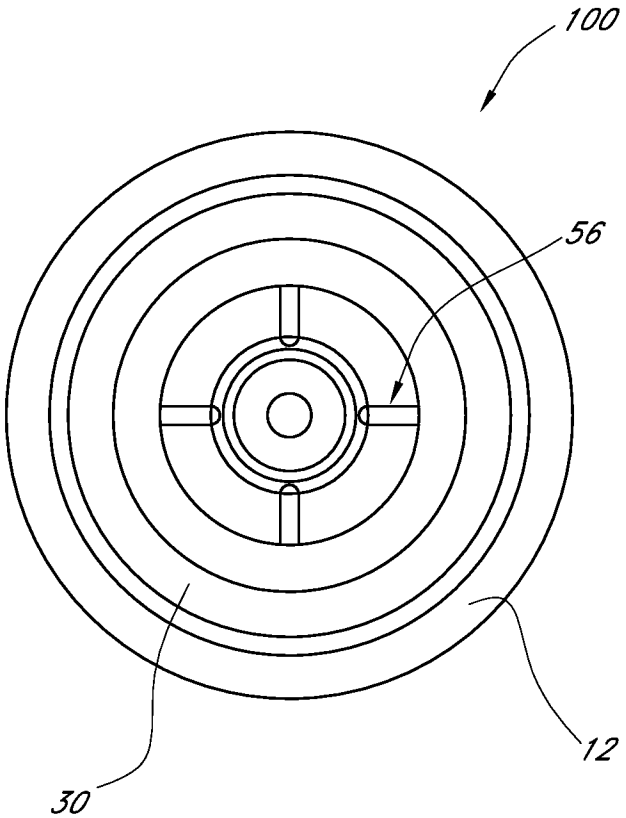
FIG. 5 is a schematic bottom view of the aerator device of FIG. 1.
Figure 4:
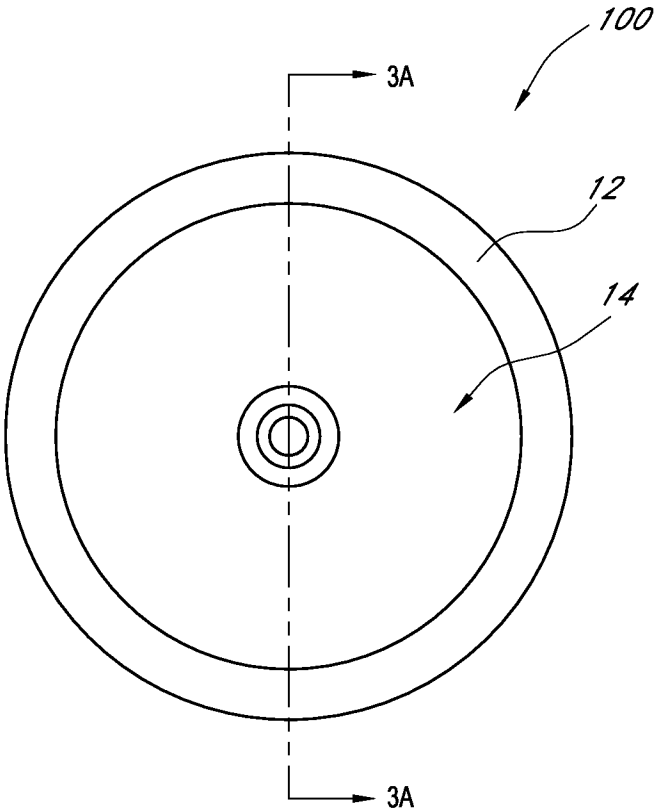
FIG. 4 is a schematic top view of the aerator device of FIG. 1 without the diffuser element.
Figure 6A:
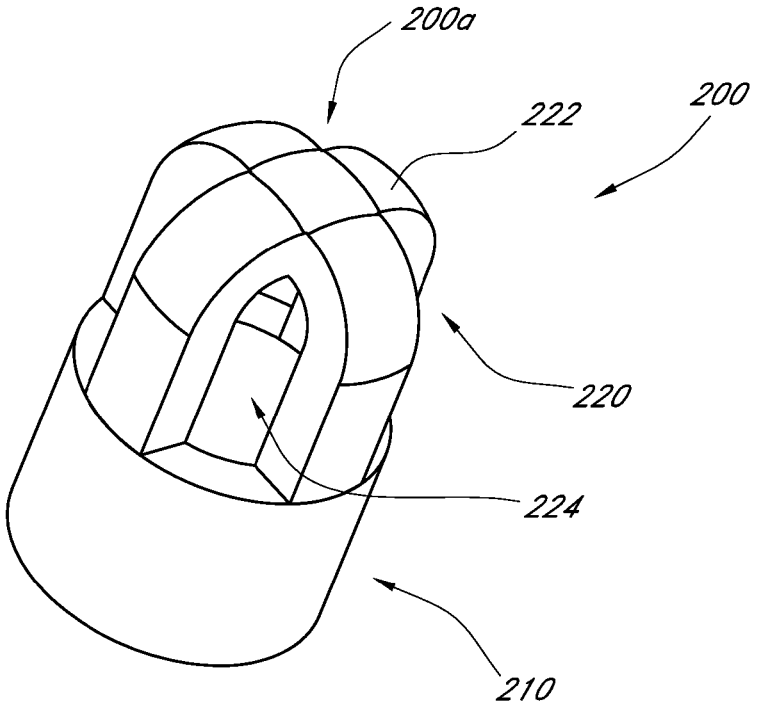
FIG. 6A is a schematic perspective top view of one embodiment of a diffuser element for use with the aerator device of FIG. 1.
Figure 6B:
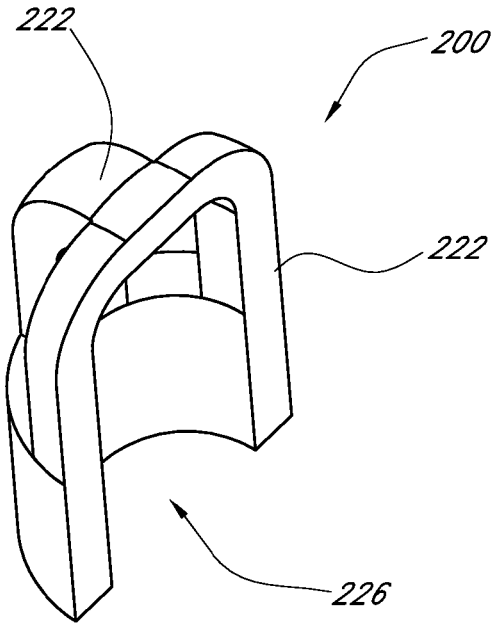
FIG. 6B is a schematic partial top view of the diffuser element of FIG. 6A.
Figure 6C:
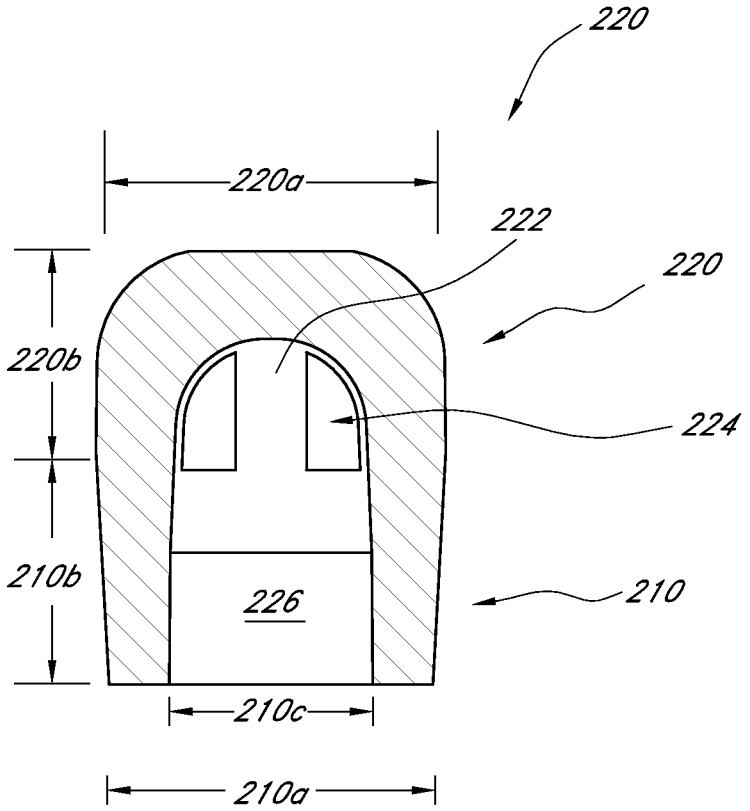
FIG. 6C is a schematic cross-sectional side view of the diffuser element of FIG. 6A.
Figure 6D:
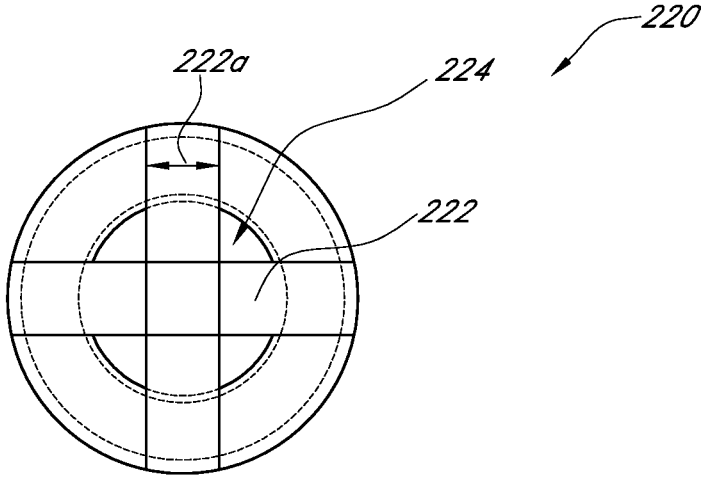
FIG. 6D is a schematic top view of the diffuser element of FIG. 6A.

With reference to FIG. 3B, the aerator device 100 can have a length L of between about 4 inches and about 7 inches. In one embodiment, the length L can be about 6 inches. The cup portion 10 can have an outer diameter 10*a* of between about 2 inches and 3 inches. In one embodiment, the outer diameter 10*a* can be about 2.4 inches. The cup portion 10 can have a first section length 10*b* of between about 1 inch and about 2 inches. In one embodiment, the first section length 10*b* can be about 1.6 inches. The recessed section 12*d* of the cup portion 10 can have a length 10*c* of between about 0.5 inches and about 1 inch. In one embodiment, the length 10*c* can be about 0.7 inches. The outer surface 12*c* of the wall 12 of the cup portion 10 can have a radius of curvature 10*d* of between about 1 inch and about 2 inches. In one embodiment, the radius of curvature 10*d* of the outer surface 12*c* can be about 1.2 inches. The outer surface 30*a* of the neck portion 30 can be curved and defined by a radius of curvature 30*c* of between about 2 inches and about 4 inches. In one embodiment, the radius of curvature 30*c* of the outer surface 30*a* can be about 3 inches. The neck portion 30 can have a length 30*d* of between about 2 inches and about 4 inches. In one embodiment the length 30*d* of the neck portion 30 can be about 3 inches. The cylindrical portion 52 of the end portion 50 and have an outer diameter 52*a* of between about 0.5 inches and about 1 inch. In one embodiment, the outer diameter 52*a* of the cylindrical portion 52 can be about 0.6 inches. The tapered portion 54 of the end portion 50 can have a distal outer diameter 54*a* of between about 0.4 inches and about 0.75 inches. In one embodiment, the distal outer diameter 54*a* can be about 0.6 inches. The end portion 50 can be sized and shaped to extend into and fit within an opening of a bottle (not shown), such as the opening of a wine bottle, as further discussed below. The first chamber 16, aeration chamber 18 and passage 32 define a fluid flow path F between the cavity 14 of the cup portion 10 and the distal end D of the aerator device 100.

FIGS. 6A-6D show one embodiment of a diffuser element 200. As shown in FIG. 2A-2B, the diffuser element 200 can be used with the aerator device 100. The diffuser element 200 can have a base portion 210 and a top portion 220. The base portion 210 can have an outer shape that generally corresponds to the shape of the first chamber 16 of the aerator device. In the illustrated embodiment, the base portion 210 is generally cylindrical. The top portion 220 can have one or more arms 222 that extend from the base portion 210 to a proximal end 200*a* of the diffuser element 200. In the illustrated embodiment, the top portion 220 has four arms 222 that join each other at the proximal end 200*a* so as to define a cross-shape. The arms 222 are arranged at 90° from each other, so as to define openings 224 between adjacent arms that communicate with a central passage 226 of the diffuser element 200 that extends from the top portion 220 to a distal opening.

The base portion 210 of the diffuser element 200 can have an outer diameter 210*a* of between about 0.2 inches and about 0.5 inches. In one embodiment, the outer diameter 210*a* is about 0.4 inches. The base portion 210 can have a length 210*b* of between about 0.2 inches and about 0.5 inches. In one embodiment, the length 210*b* can be about 0.25 inches. The passage 226 of the diffuser element 200 can have an inner diameter 210*c* of between about 0.2 inches and about 0.5 inches. In one embodiment, the diameter 210*c* can be about 0.25 inches.

The top portion 220 of the diffuser element 200 can have an outer diameter 220*a* of between about 0.3 inches and about 0.5 inches. In one embodiment, the outer diameter 220*a* can be about 0.4 inches. The top portion 220 can have a length 220*b* of between about 0.2 inches and about 0.5 inches. In one embodiment, the length 220*b* can be about 0.25 inches. Each of the arms 222 can have a width 222*a* of between about 0.05 inches and about 0.1 inch. In one embodiment, the width 222*a* can be about 0.08 inches.

As shown in FIGS. 2A-2B, the diffuser element 200 can be coupled to the aerator device 100 so that the diffuser element 200 at least partially extends into the first chamber 16. In one embodiment, the diffuser element 200 is press-fit into the first chamber 16. In one embodiment, the base portion 210 of the diffuser element 200 substantially completely extends into the first chamber 16 so that the top portion 210 substantially completely extends into the cavity 14 of the cup portion 10. Additionally, the inner diameter 210*c* of the base portion 210 can be generally equal to the diameter 18*d* of the aeration chamber 18 of the aerator device 100, so that when the diffuser element 200 is coupled to the aerator device 100 fluid flows between the cavity 14 and the passage 32 passes through a section of substantially constant diameter.

In use, a user can pour a fluid (e.g., wine) into the cavity 14 of the cup portion 10 of the aerator device 100. The fluid can then flow into the top portion 220 the diffuser device 200 and through the passage 226 into the aeration chamber 18 of the aerator device 100. As the fluid flows into the aeration chamber 18 it experiences a drop in pressure, which causes air to be drawn into the aeration chamber 18 from outside the aerator device 100 via the passages 20 so that the air mixes with the fluid in the aeration chamber 18. The fluid then passes into the passage 32 and out the distal end D of the aerator device 100. The top portion 220 of the diffuser device 200 advantageously inhibits the swirling of the fluid as it passes from the cavity 14 into the aeration chamber 18, so that that the fluid flows vertically through the aeration chamber 18 thereby resulting in improved mixture of the fluid with the air that is drawn into the aeration chamber 18. In particular, the arms 222 of the top portion 220 of the diffuser element 200 counteract any swirling action of the fluid as it moves toward the diffuser 200 and guides the fluid flow into a substantially linear and vertical flow through the aeration chamber 18.

FIGS. 7A-7D show another embodiment of an aerator device 100'. The aerator device 100' is similar to the aerator device 100 described above and can have the same components as the aerator device 100, except as noted below. Thus, the reference numerals used to designate the various components of the aerator device 100' are identical to those used for identifying the corresponding components of the aerator device 100 in FIGS. 1-5, except that a "'" has been added to the reference numerals. Unless noted below, the description of the components of the aerator device 100' is the same as the description of the corresponding components of the aerator device 100 provides above.

In the illustrated embodiment, the cavity 14' transitions into a straight section 16' so that the inner surface 12*b'* of the cup portion 10' transitions from a curved section to a straight or linear section. The straight section 16' of the cavity 14' fluidly communicates with the aeration chamber 18'.

The opening 12*a'* of the cup portion 10' can have diameter of between about 1.5 inches and about 3 inches. In one embodiment, the opening 12*a'* can have a diameter of about 2 inches. The inner surface 12*b'* of the cup portion 10' can have a curvature defined by a radius of curvature of between about 1 inch and about 2 inches. In one embodiment, the inner surface 12*b'* can have a curvature defined by a radius of curvature of about 1.5 inches. The straight section 16' of the cavity 14' can have a diameter 16*a'* of between about 0.5 inches and about 1 inch. In one embodiment, the diameter 16*a'* of the straight section 16' can be about ¾ inches. The straight section 16' can have a length 16*b'* of between about 0.1 inches and about 0.5 inches. In one embodiment, the length 16*b'* of the straight section 16' can be about 0.2 inches. The straight section 16' can have a distal opening 16*c'* that communicates with the aeration chamber 18', and the opening 16*c'* can have a diameter 18*d'* of between about 0.3 inches and about 0.7 inches, which is substantially constant along the length of the aeration chamber 18', where the diameter 18' of the aeration chamber 18' is smaller than the diameter 16*a'* of the straight section 16'. In one embodiment, the diameter 18*d'* can be about 0.5 inches. The aeration chamber 18' can have a length 18*b'* of between about 0.2 inches and about 0.5 inches. In one embodiment, the length 18*b'* can be about 0.3 inches.

Figure 7A:
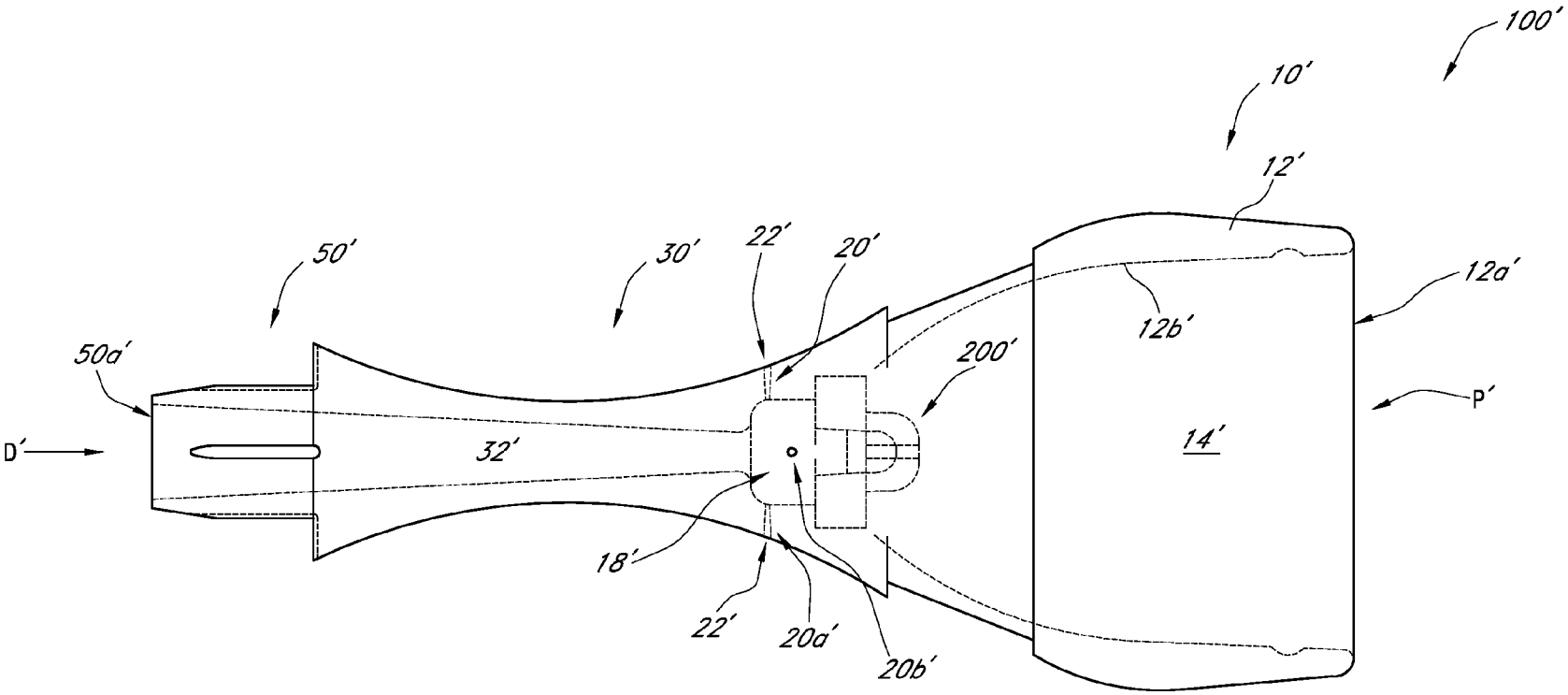
FIG. 7A is a schematic side view of another embodiment of an assembled aerator device.
Figure 7B:
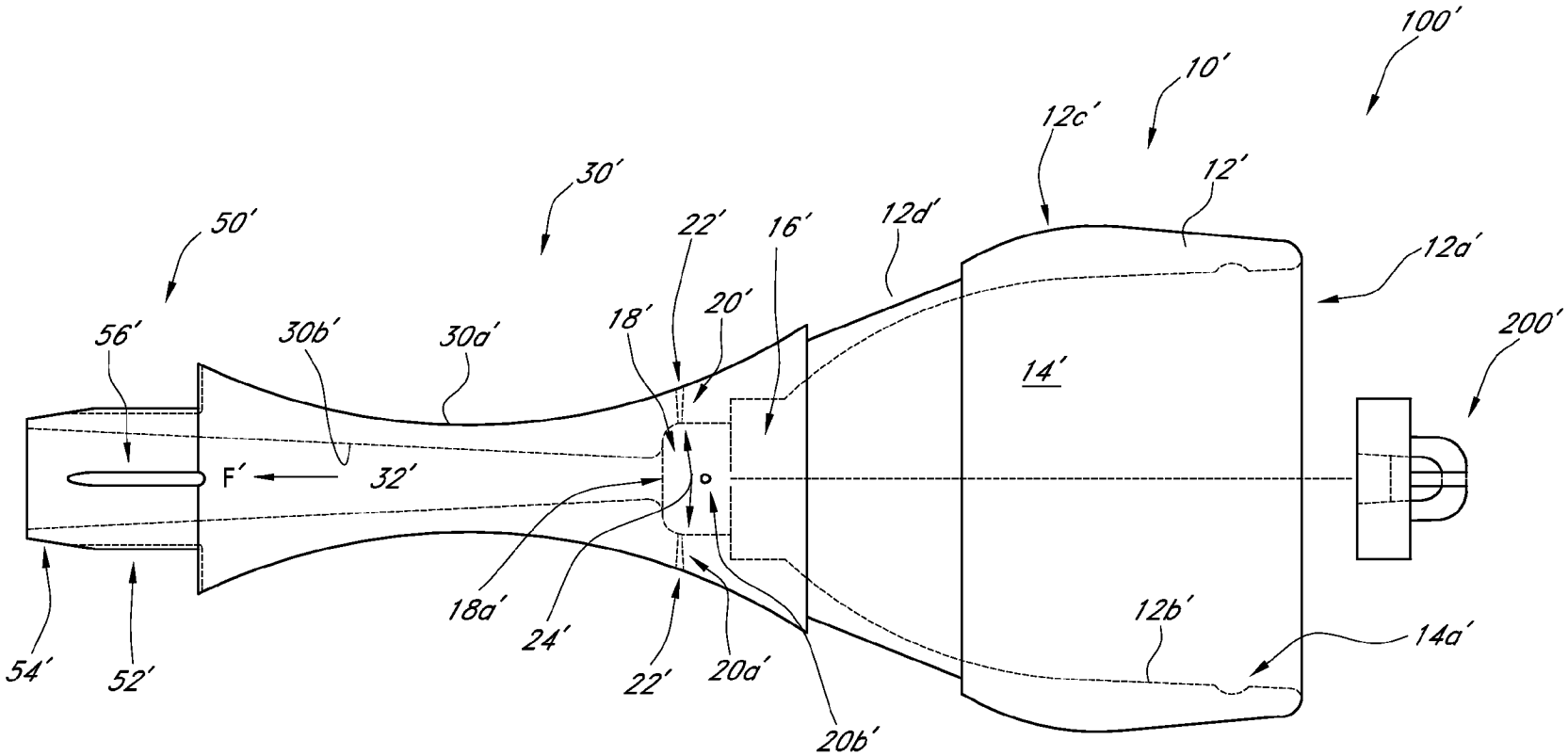
FIG. 7B is a schematic exploded side view of the aerator device of FIG. 7A.
Figure 7C:
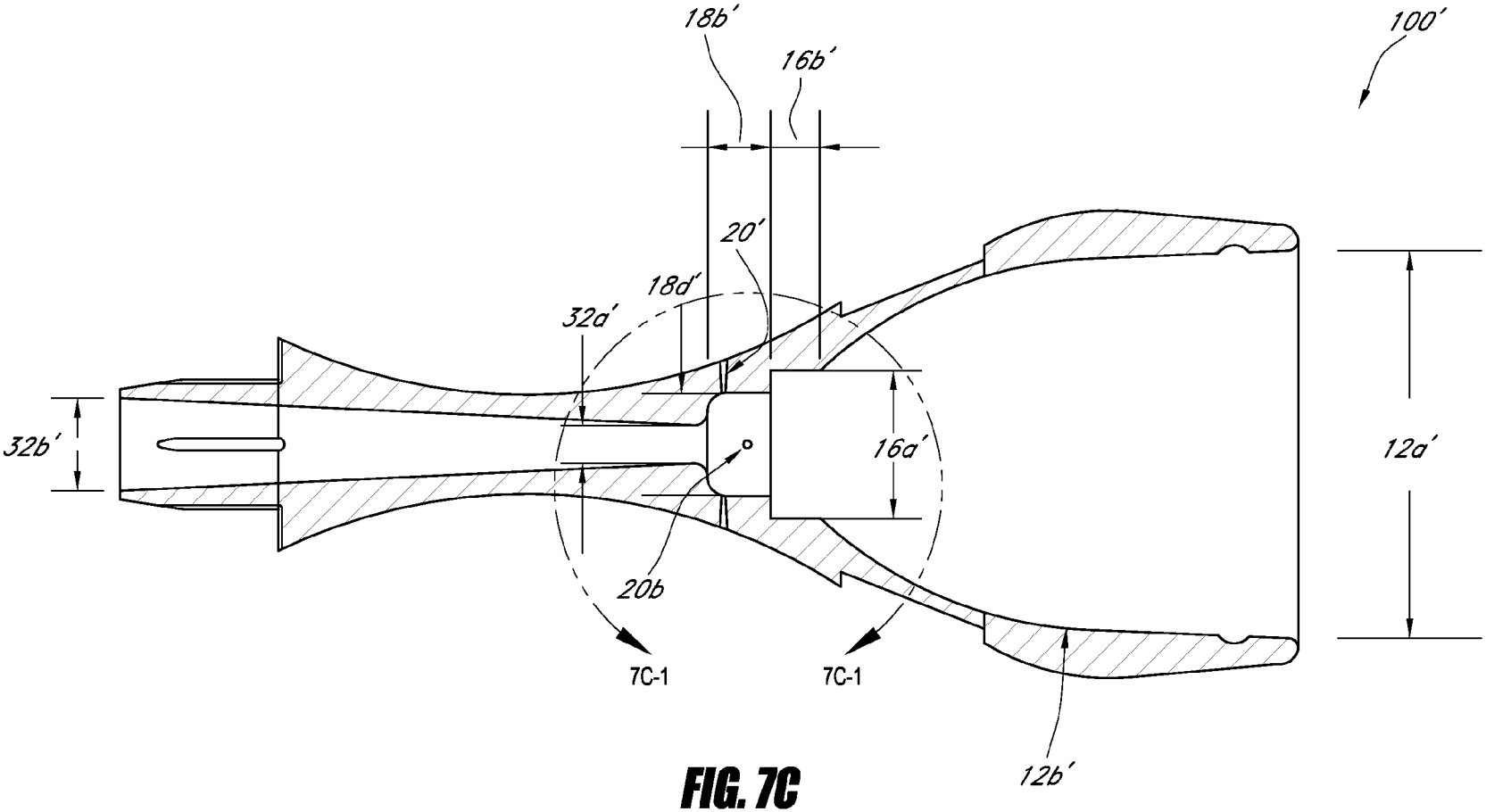
FIG. 7C is a schematic cross-sectional side view of the aerator device of FIG. 7A without the diffuser element.
Figures 1, 7C:
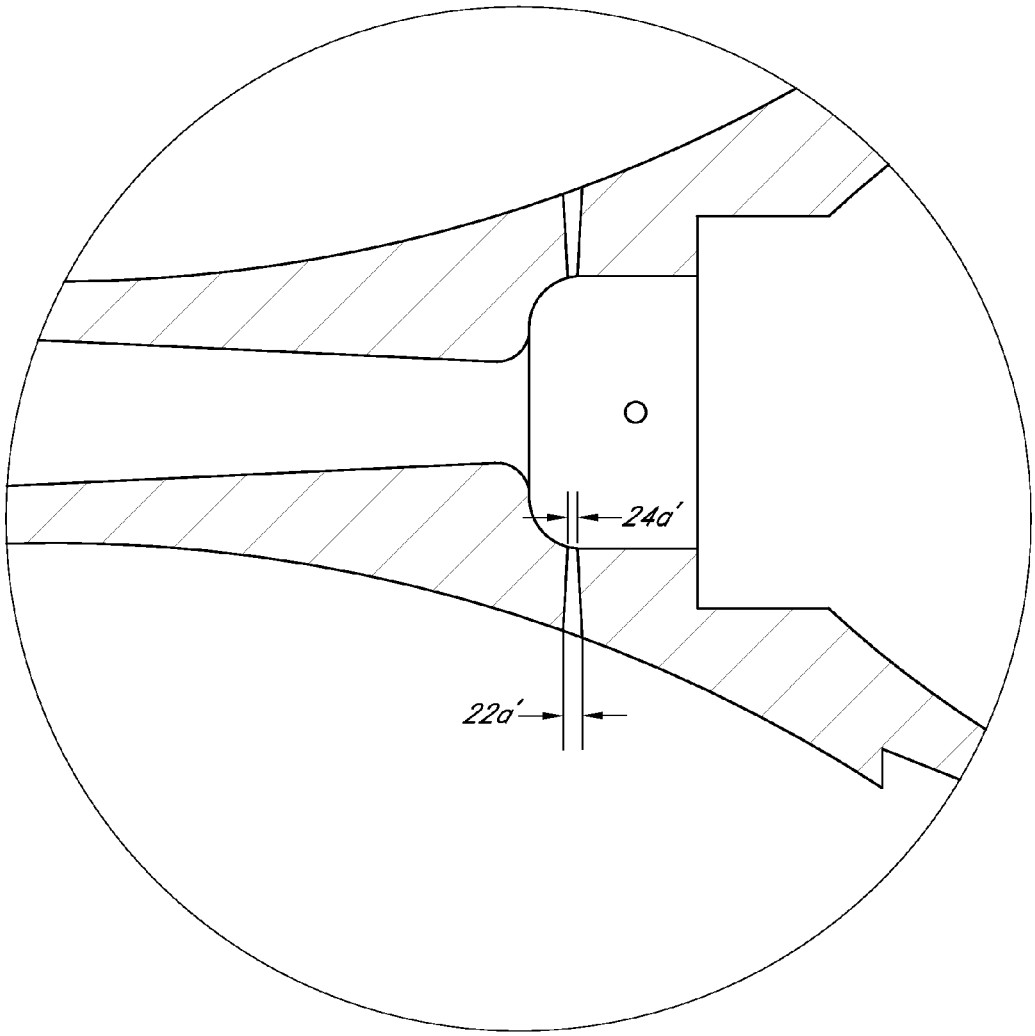
Figure 7D:
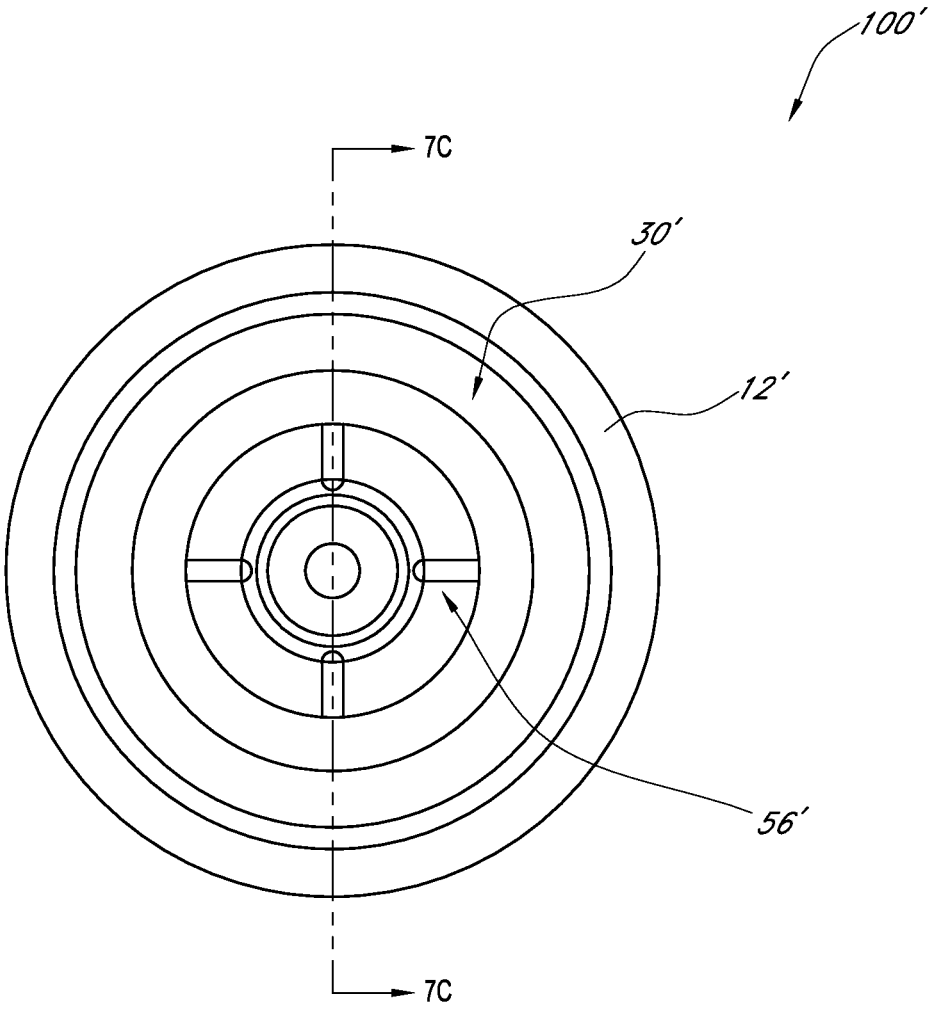
FIG. 7D is a schematic bottom view of the aerator device of FIG. 7A without the diffuser element.
Figure 8A:
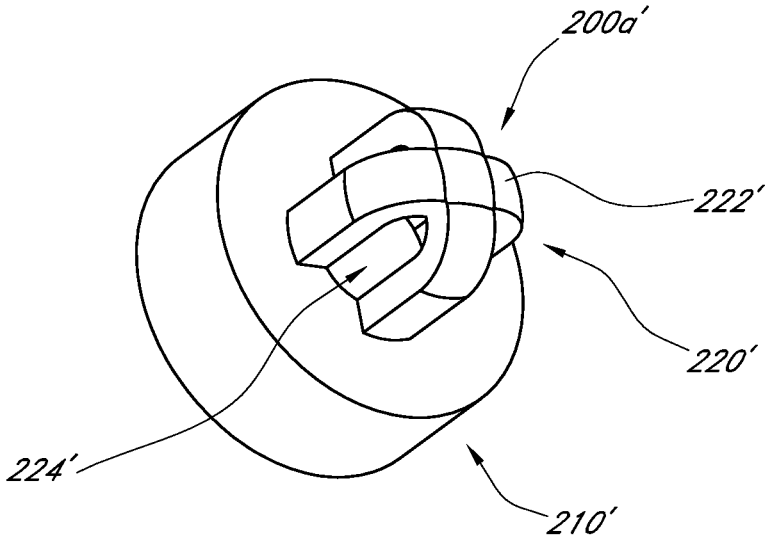
FIG. 8A is a schematic perspective top view of one embodiment of a diffuser element for use with the aerator device of FIG. 7A.
Figure 8B:
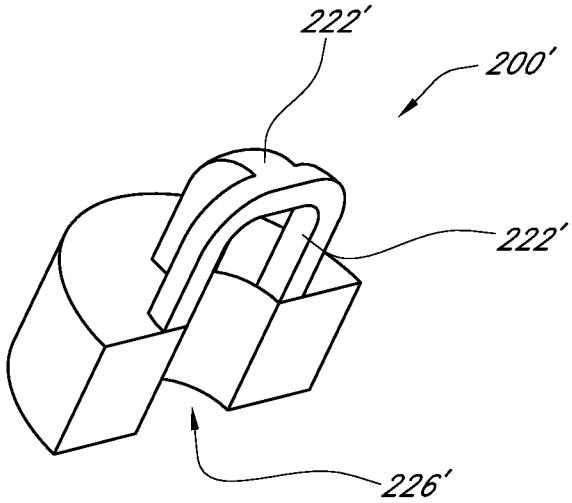
FIG. 8B is a schematic partial top view of the diffuser element of FIG. 8A.
Figure 8C:
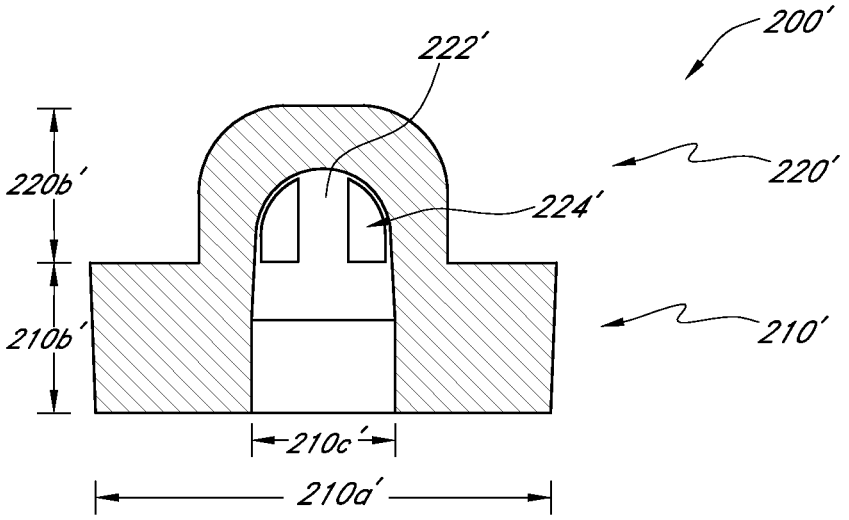
FIG. 8C is a schematic cross-sectional side view of the diffuser element of FIG. 8A.
Figure 8D:
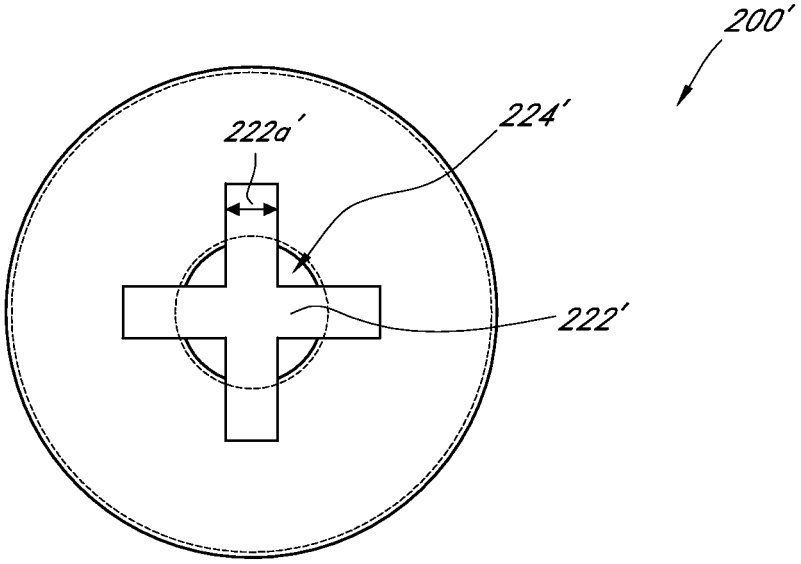
FIG. 8D is a schematic top view of the diffuser element of FIG. 8A.

With continued reference to FIGS. 7B-7C, the aerator device 100' has four passages 20' disposed generally at 90° relative to each other, with each two of the passages 20' disposed on opposite sides of the aeration chamber 18' from each other. In the illustrated embodiment, one pair of passages 20*a'* are disposed opposite each other in the aeration chamber 18', and a second pair of passages 20*b'* (shown normal to the page) are disposed opposite to each other in the aeration chamber 18'. As shown, for example, in FIG. 7B, the passages 20*b'* are located on a plane upstream of a plane on which the passages 20*a'* are located, so that the aeration chamber 18' has four passages 20' with two passages 20*b'* in a proximal section of the chamber 18' and two passages 20*a'* in a distal section of the chamber 18'. The offset passages 20' advantageously provides for improved aeration of the fluid as it passes through the aeration chamber 18'. In one embodiment, the passages 20*b'* can be located about halfway along the length of the aeration chamber 18'. The inner opening 24' of the passages 20' can have a diameter 24*a'* of between about 0.01 and 0.03 inches and the outer opening 22' of the passages 20' can have a diameter 22*a'* of between about 0.02 and 0.04 inches. The passages 20' can extend generally perpendicularly to the longitudinal axis X of the aerator device 100'.

The aeration chamber 18' can have a distal opening 18*a'* that fluidly communicates the aeration chamber 18' with the passage 32'. The passage 32' can have a proximal end diameter 32*a'* of between about 0.1 inches and 0.3 inches. In one embodiment, the proximal end diameter 32' of the passage 32' can be about 0.2 inches. The passage 32' can extend to the distal opening 50*a'* in the aerator device 100, which can have a distal end diameter 32*b'* of between about 0.3 and about 0.7 inches. In one embodiment, the distal end diameter 32*b'* can be about 0.5 inches.

FIGS. 8A-8D show another embodiment of a diffuser element 200'. The diffuser element 200' is similar to the diffuser element 200 described above and can have the same components as the diffuser element 200, except as noted below. Thus, the reference numerals used to designate the various features of the diffuser element 200' are identical to those used for identifying the corresponding features of the diffuser element in FIGS. 6A-6D, except that a "'" has been added to the reference numerals. Unless noted below, the description of the features of the diffuser element 200' is the same as the description of the corresponding features of the diffuser element 200 provides above.

FIGS. 8A-8D show another embodiment of a diffuser element 200'. As shown in FIGS. 7A-7B, the diffuser element 200' can be used with the aerator device 100'. The diffuser element 200' can have a base portion 210' and a top portion 220'. The base portion 210' can have an outer shape that generally corresponds to the shape of the straight section 16' of the aerator device 100'. In the illustrated embodiment, the base portion 210' is generally cylindrical. The top portion 220' can have one or more arms 222' that extend from the base portion 210' to a proximal end 200*a'* of the diffuser element 200'. In the illustrated embodiment, the top portion 220' has four arms 222' that join each other at the proximal end 200*a'* so as to define a cross-shape. The arms 222' are arranged at 90° from each other, so as to define openings 224' between adjacent arms that communicate with a central passage 226' of the diffuser element 200' that extends from the top portion 220' to a distal opening.

The base portion 210' of the diffuser element 200' can have an outer diameter 210*a'* of between about 0.5 inches and about 1 inch. In one embodiment, the outer diameter 210*a'* is about 0.75 inches. The base portion 210' can have a length 210*b'* of between about 0.2 inches and about 0.5 inches. In one embodiment, the length 210*b'* can be about 0.25 inches. The passage 226' of the diffuser element 200' can have an inner diameter 210*c'* of between about 0.2 inches and about 0.5 inches. In one embodiment, the diameter 210*c'* can be about 0.25 inches.

The top portion 220' of the diffuser element 200' can have a length 220*b'* of between about 0.2 inches and about 0.5 inches. In one embodiment, the length 220*b'* can be about 0.25 inches. Each of the arms 222' can have a width 222*a'* of between about 0.05 inches and about 0.1 inch. In one embodiment, the width 222*a'* can be about 0.08 inches.

As shown in FIGS. 7A-7B, the diffuser element 200' can be coupled to the aerator device 100' so that the diffuser element 200' at least partially extends into the straight section 16'. In one embodiment, the diffuser element 200' is press-fit into the straight section 16'. In one embodiment, the base portion 210' of the diffuser element 200' extends into the straight section 16' so that the top portion 210' completely extends into the cavity 14' of the cup portion 10'.

In use, a user can pour a fluid (e.g., wine) into the cavity 14' of the cup portion 10' of the aerator device 100'. The fluid can then flow into the top portion 220' the diffuser device 200', and through the openings 224' and the passage 226' into the aeration chamber 18' of the aerator device 100'. As the fluid flows into the aeration chamber 18', air is drawn by the flow F' into the aeration chamber 18 from outside the aerator device 100' via the passages 20' so that the air mixes with the fluid in the aeration chamber 18'. The fluid then passes into the passage 32' and out the distal end D' of the aerator device 100'. The top portion 220' of the diffuser device 200' advantageously inhibits the swirling of the fluid as it passes from the cavity 14' into the aeration chamber 18', so that that the fluid flows vertically through the aeration chamber 18' thereby resulting in improved mixture of the fluid with the air that is drawn into the aeration chamber 18'. In particular, the arms 222' of the top portion 220' of the diffuser element 200' counteract any swirling action of the fluid as it moves toward the diffuser 200' and guides the fluid flow into a substantially linear and vertical flow through the aeration chamber 18'.

FIGS. 9A-9D show another embodiment of an aerator device 100". The aerator device 100" is similar to the aerator device 100 described above and can have the same components as the aerator device 100, except as noted below. Thus, the reference numerals used to designate the various components of the aerator device 100" are identical to those used for identifying the corresponding components of the aerator device 100 in FIGS. 1-5, except that a "" has been added to the reference numerals. Unless noted below, the description of the components of the aerator device 100" is the same as the description of the corresponding components of the aerator device 100 provides above.

In the illustrated embodiment, the cavity 14' transitions into a straight section 16" so that the inner surface 12*b*" of the cup portion 10" transitions from a curved section to a straight or linear section. The straight section 16" of the cavity 14" is adjacent to and fluidly communicates with the passage 32".

The opening 12*a*" of the cup portion 10" can have diameter of between about 1.5 inches and about 3 inches. In one embodiment, the opening 12*a*" can have a diameter of about 2 inches. The inner surface 12*b*" of the cup portion 10" can have a curvature defined by a radius of curvature 12*e*" of between about 1 inch and about 2 inches.

In one embodiment, the radius of curvature 12*e*" can be about 1.5 inches. The straight section 16" of the cavity 14" can have a diameter 16*a*" of between about 0.5 inches and about 1 inch. In one embodiment, the diameter 16*a*" of the straight section 16" can be about ¾ inches. The straight section 16" can have a length 16*b*" of between about 0.1 inches and about 0.5 inches. In one embodiment, the length 16*b*" of the straight section 16" can be about 0.25 inches. The straight section 16" can have a distal opening 16*c*" that communicates with a proximal section 32*b*" of the passage 32", and the opening 16*c*" can have a diameter 32*a*" of between about 0.4 inches and about 0.8 inches. In one embodiment, the diameter 32*a*" can be about 0.6 inches. The passage 32" can decrease in diameter in a proximal section 32*b*" thereof between the distal opening 16*c*" and a throat section 32*d*" that can have a diameter between 0.1 inches and 0.3 inches. In one embodiment, the diameter of the throat section 32*d*" can be about 0.2 inches. The passage 32" can increase in diameter in a distal section 32*c*" thereof between the throat section 32*d*" and the distal opening 50*a*" of the aerator device 100", where the distal opening 50*a*" can have a diameter of between 0.2 inches and about 0.7 inches. In one embodiment, the diameter of the distal opening 50*a*" can be about 0.5 inches.

Figure 9A:
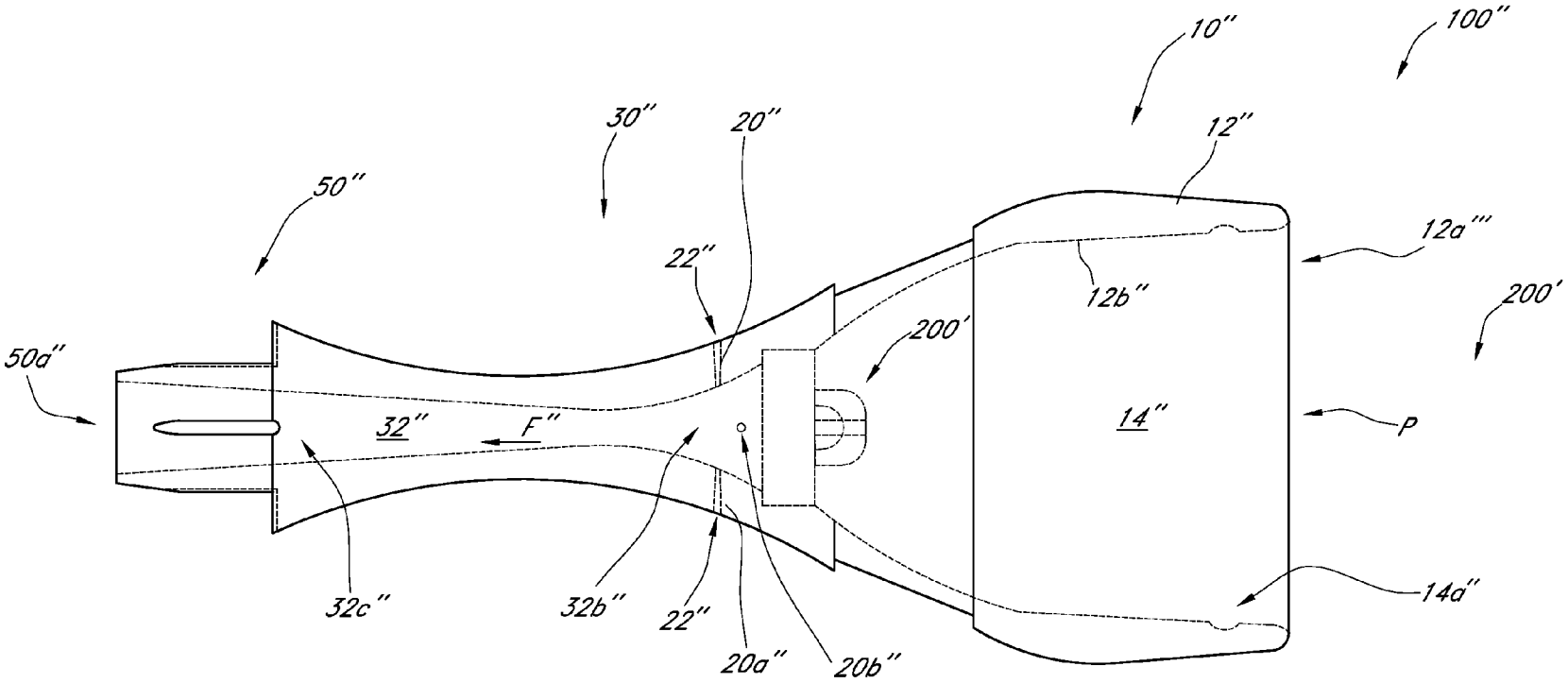
FIG. 9A is a schematic side view of another embodiment of an assembled aerator device.
Figure 9B:
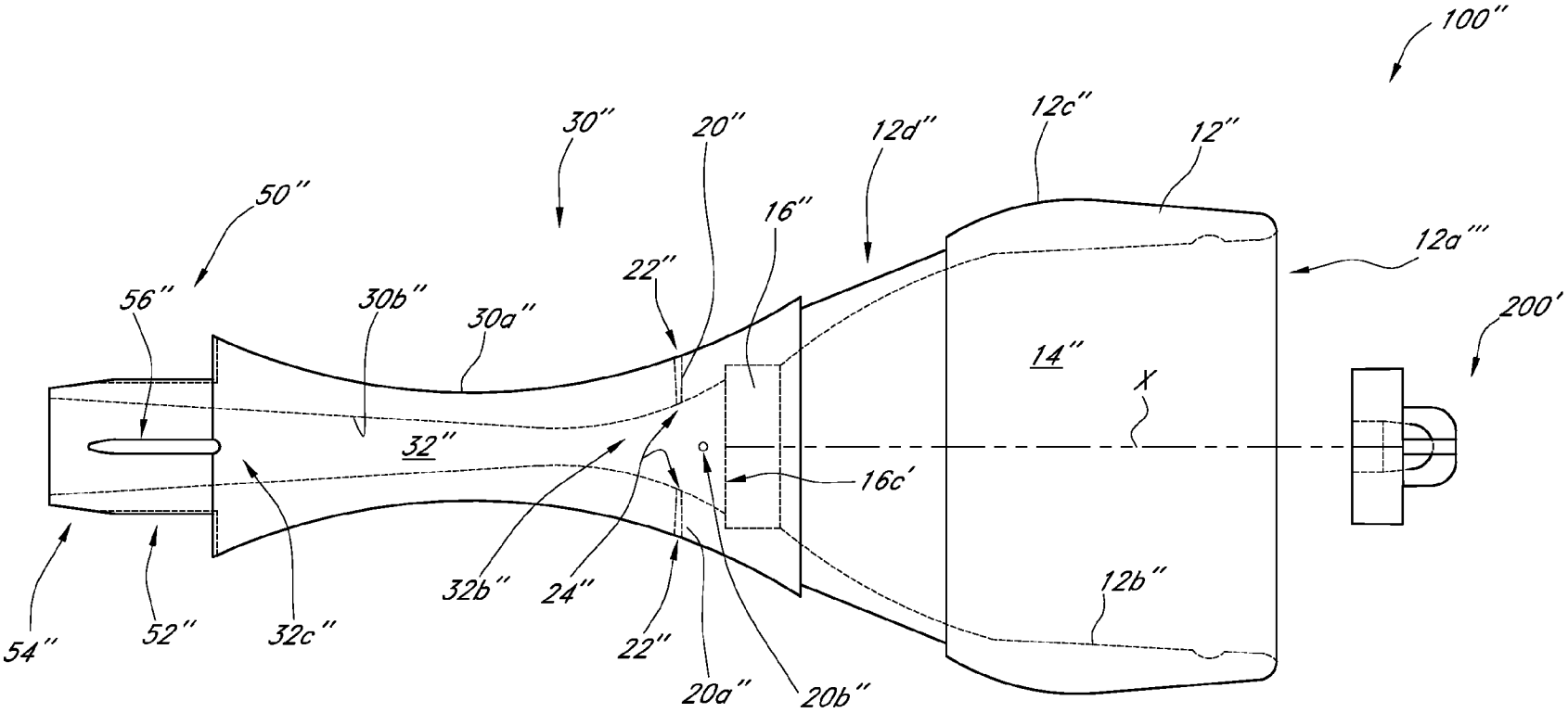
FIG. 9B is a schematic exploded side view of the aerator device of FIG. 9A.
Figure 9C:
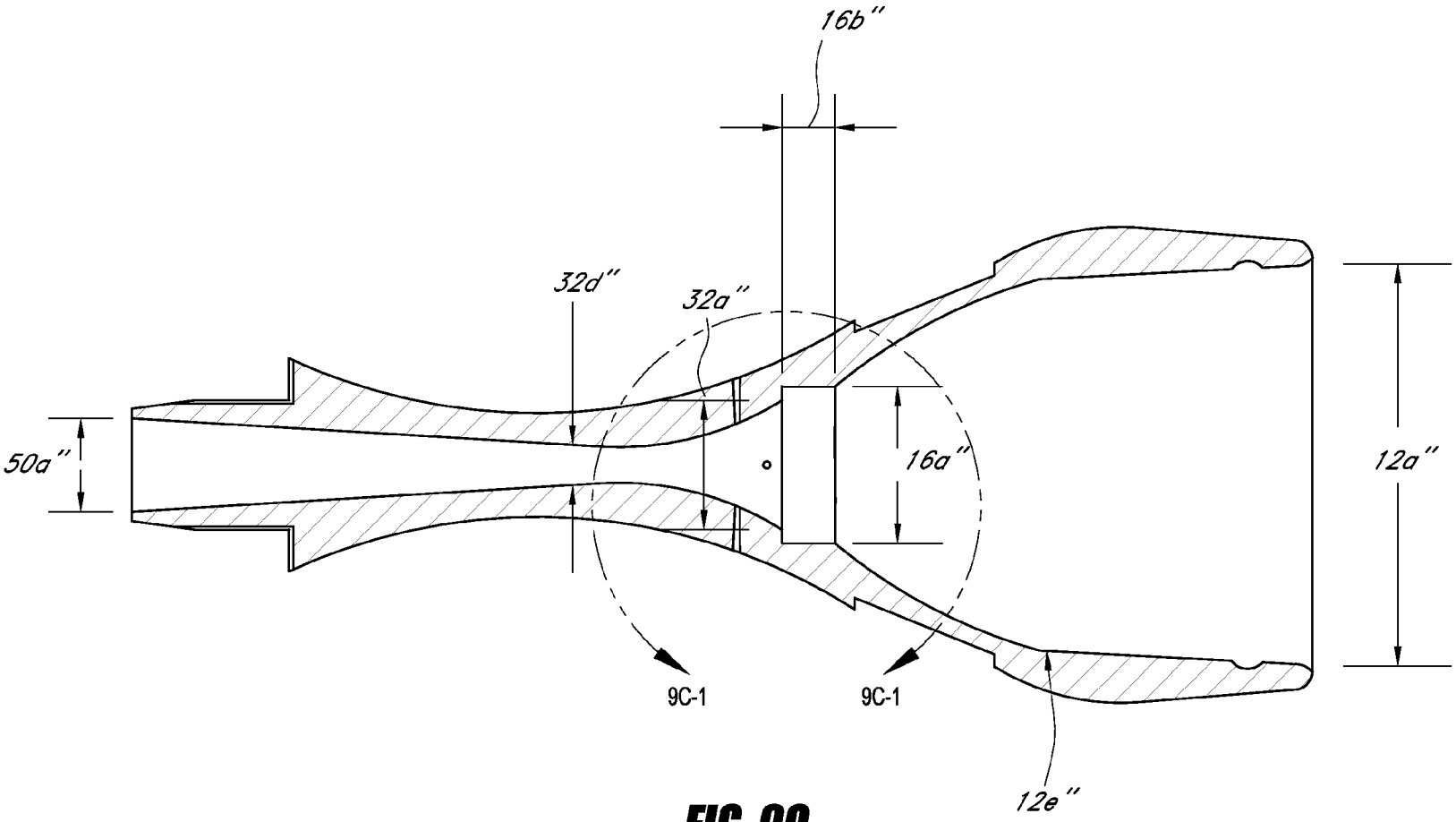
FIG. 9C is a schematic cross-sectional side view of the aerator device of FIG. 9A without the diffuser element.
Figures 1, 9C:
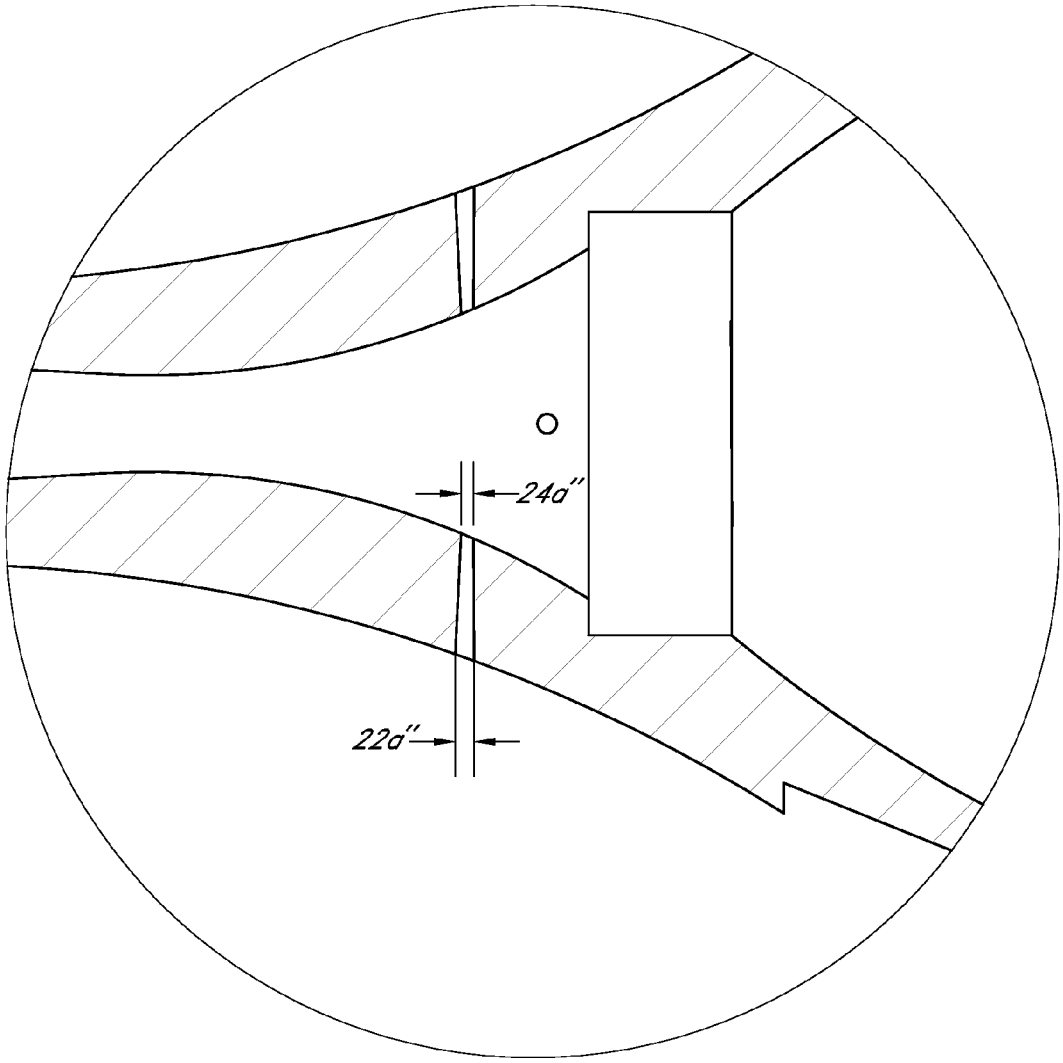
Figure 9D:
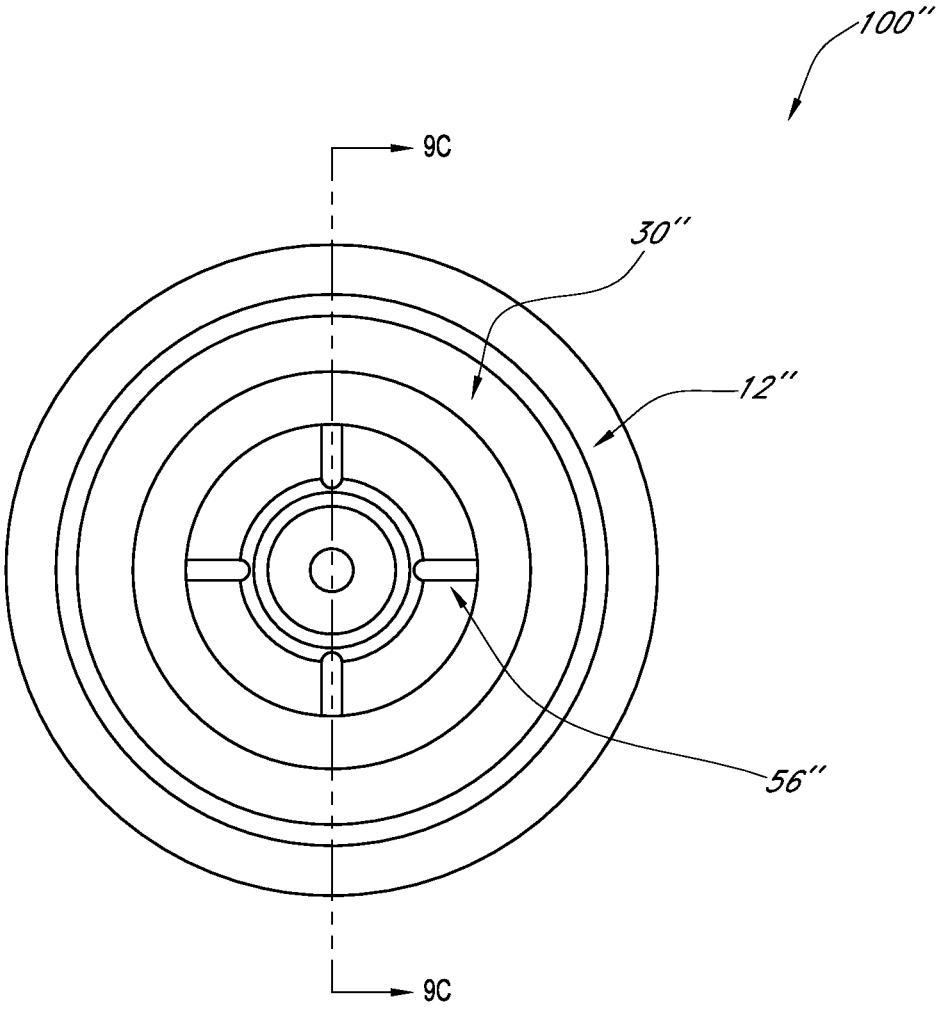
FIG. 9D is a schematic bottom view of the aerator device of FIG. 9A without the diffuser element.
Figure 10A:
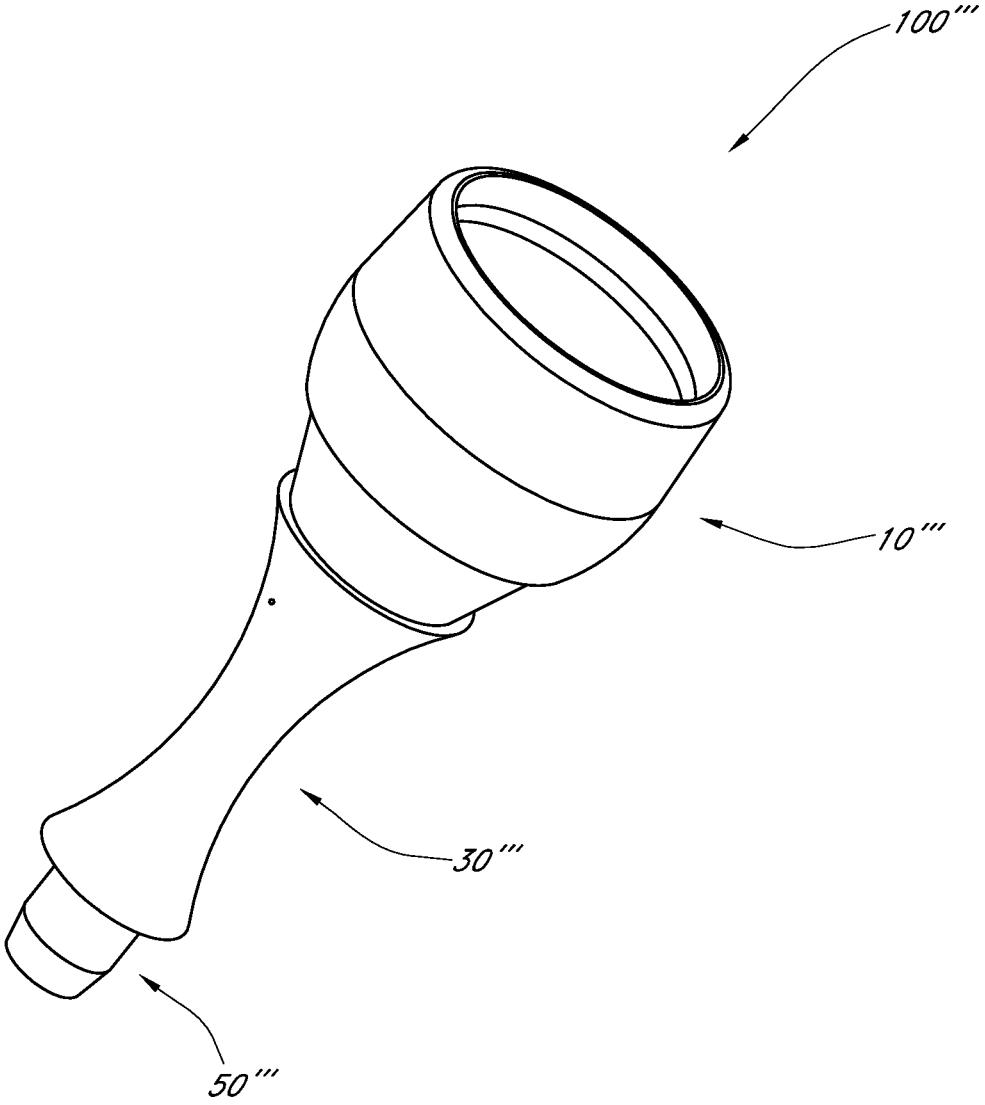
FIG. 10A is a schematic perspective top view of another embodiment of an aerator device.
Figure 10B:
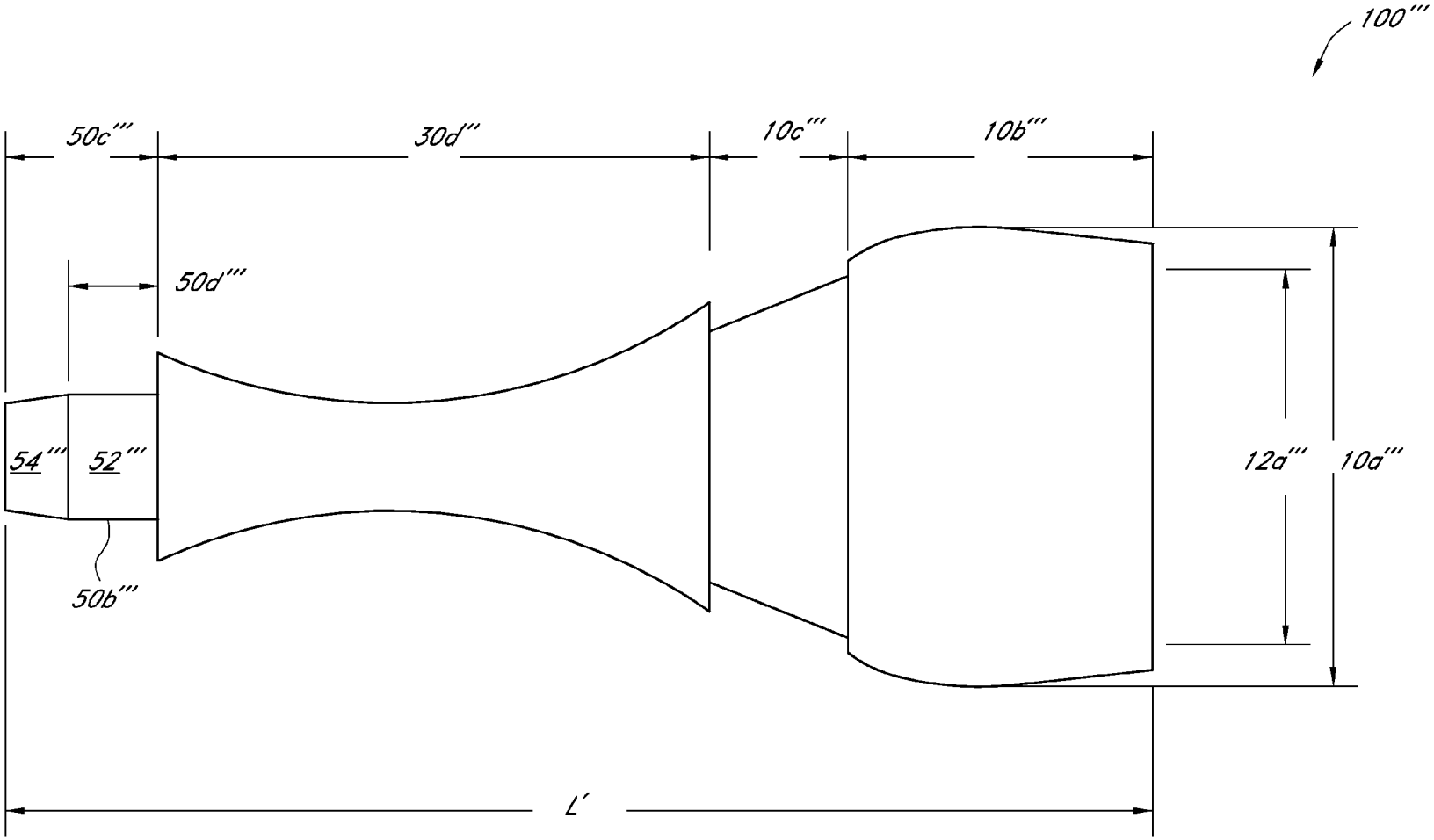
FIG. 10B is a schematic perspective side view of the aerator device of FIG. 10A.
Figure 10C:
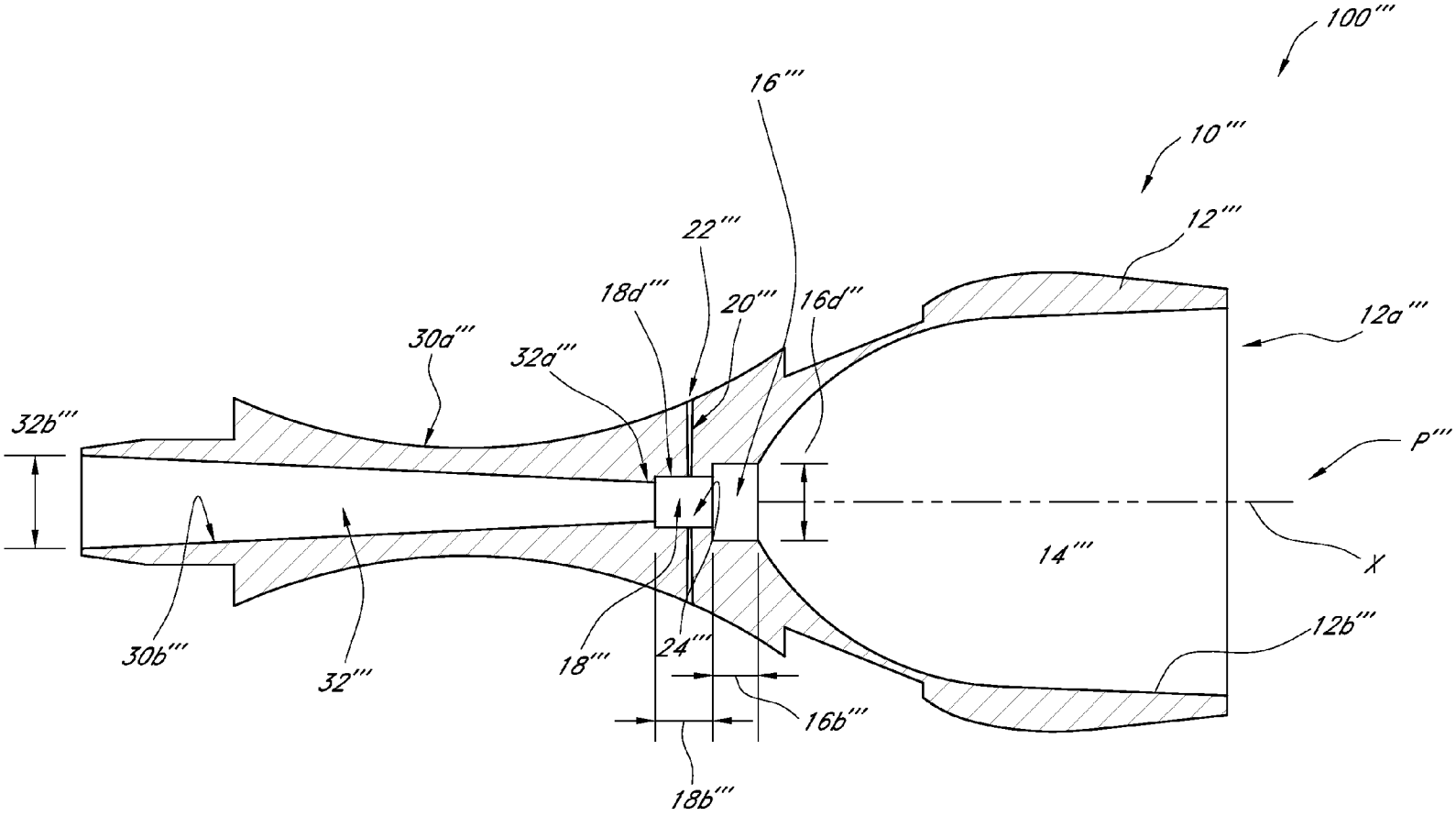
FIG. 10C is a schematic cross-sectional side view of the aerator device of FIG. 10A without the diffuser element.
Figure 10D:
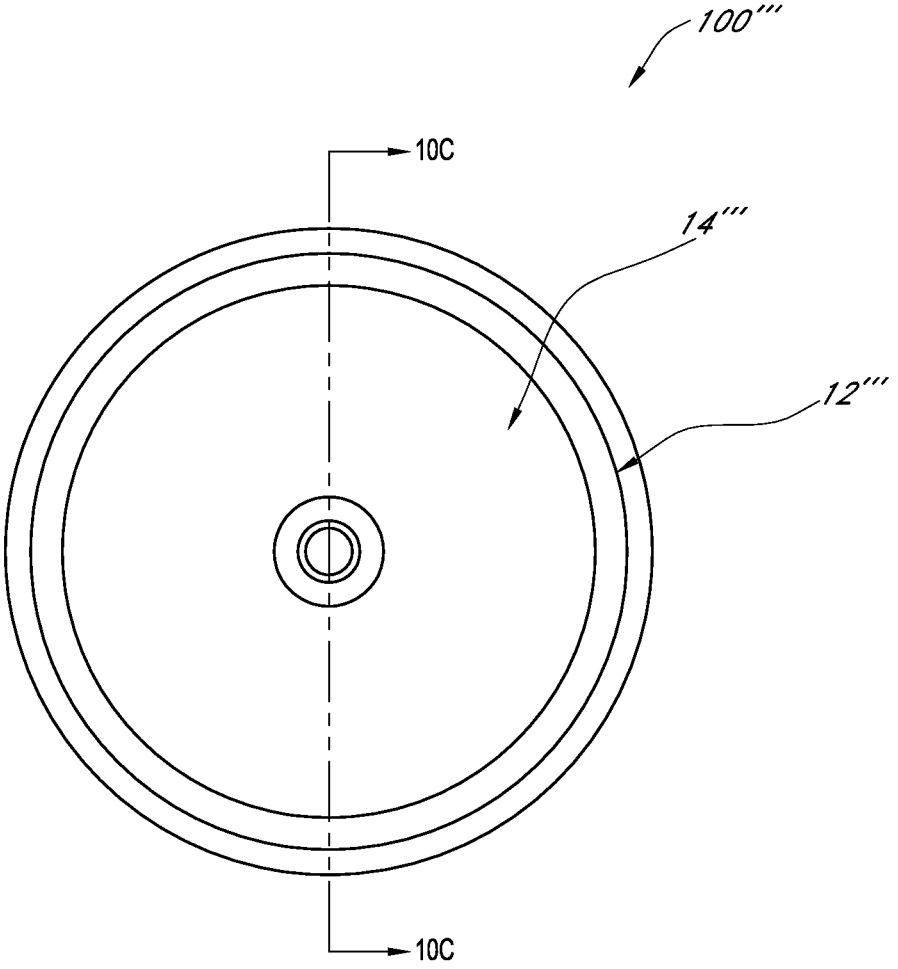
FIG. 10D is a schematic top view of the aerator device of FIG. 10A.
Figure 11C:
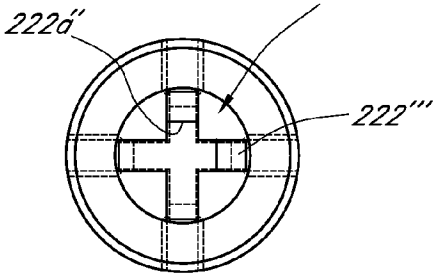
FIG. 11C is a schematic top view of the diffuser element of FIG. 11A.
Figure 11B:
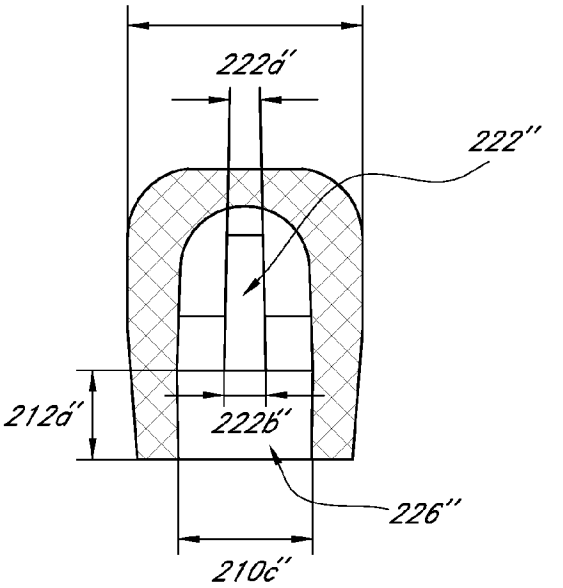
FIG. 11B is a schematic cross-sectional side view of the diffuser element in FIG. 10A.
Figure 11A:
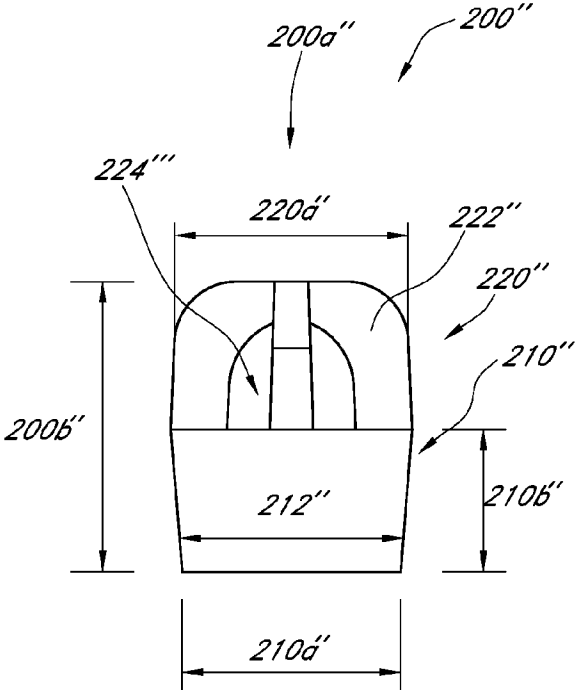
FIG. 11A is a schematic side view of another embodiment of a diffuser element for use with the aerator of FIG. 10A.

With continued reference to FIG. 9A-9C, the aerator device 100" has four passages 20" disposed generally at 90° relative to each other, with each two of the passages 20" disposed on opposite sides of the proximal section (aeration section) 32*b*" of the passage 32" from each other. In the illustrated embodiment, one pair of passages 20*a*" are disposed opposite each other in the aeration section 32*b*", and a second pair of passages 20*b*" (shown normal to the page) are disposed opposite to each other in the aeration section 32*b*". As shown, for example, in FIG. 9B, the passages 20*b*" are located on a plane upstream of a plane on which the passages 20*a*" are located, so that the aeration section 32*b*" has four passages 20" with two passages 20*b*" in a proximal section of the aeration section 32*b*" and two passages 20*a*" in a distal section of the aeration section 32*b*". The offset passages 20" advantageously provides for improved aeration of the fluid as it passes through the aeration section 32*b*". The passages 20*a*" can be disposed in the proximal section 32*b*" (e.g., aeration section) of the passage 32" at a location proximal of the throat section 32*d*" of the passage 32", that is between the distal opening 16*c* of the straight section 16" and the throat section 32*d*". However, in other embodiments, the passages 20*a*" can be located at the throat section 32*d*" or in the distal section 32*c*" of the passage 32". The inner opening 24" of the passages 20" can have a diameter 24*a*" of between about 0.005 and 0.02 inches and the outer opening 22" of the passages 20" can have a diameter 22*a*" of between about 0.02 and 0.04 inches. The passages 20" can extend generally perpendicularly to the longitudinal axis X of the aerator device 100".

As shown in FIGS. 9A-9B, the diffuser element 200', as described above, can be used with the aerator device 100". The diffuser element 200' can be coupled to the aerator device 100" so that the diffuser element 200' at least partially extends into the straight section 16". In one embodiment, the diffuser element 200' is press-fit into the straight section 16". In one embodiment, the base portion 210' of the diffuser element 200' extends substantially completely into the straight section 16" so that the top portion 210' completely extends into the cavity 14" of the cup portion 10".

In use, a user can pour a fluid (e.g., wine) into the cavity 14" of the cup portion 10" of the aerator device 100". The fluid can then flow into the top portion 220' the diffuser device 200', and through the openings 224' and the passage 226' into the passage 32" of the aerator device 100". As the fluid flows into the proximal section 32*b*" of the passage 32", air is drawn by the flow F" into the passage 32" from outside the aerator device 100" via the passages 20" so that the air mixes with the fluid in the proximal section 32*b*" before the fluid passes through the throat section 32*d*" of the passage 32". The fluid then flows into the distal section 32*c*" of the passage 32' and out the distal end D' of the aerator device 100'. The top portion 220' of the diffuser device 200' advantageously inhibits the swirling of the fluid as it passes from the cavity 14" into the proximal section 32*b*" of the passage 32", so that that the fluid flows vertically through the proximal section 32*b*" thereby resulting in improved mixture of the fluid with the air that is drawn into the proximal section 32*b*". In particular, the arms 222' of the top portion 220' of the diffuser element 200' counteract any swirling action of the fluid as it moves toward the diffuser 200' and guides the fluid flow into a substantially linear and vertical flow through the proximal section 32*b*" of the passage 32".

FIGS. 10A-10D show another embodiment of an aerator device 100'". The aerator device 100'" is similar to the aerator device 100 described above and can have the same components as the aerator device 100, except as noted below. Thus, the reference numerals used to designate the various components of the aerator device 100'" are identical to those used for identifying the corresponding components of the aerator device 100 in FIGS. 1-5, except that a "" has been added to the reference numerals. Unless noted below, the description of the components of the aerator device 100" is the same as the description of the corresponding components of the aerator device 100 provides above.

In the illustrated embodiment, the aerator device 100'" does not have a fill indicator or line 14*a* defined on the inner surface 12*b*'" of the wall 12'". Additionally, the aerator device 100" does not have one or more channels 56 formed on an outer surface 50*b*'" of the end portion 50" of the aerator device 100". Further, the aerator device 100" has two passages 20'" formed in the neck portion 30'" and that extend from an outer surface 30*a*'" of the neck portion 30'" to the aeration chamber 18". The passages 20'" are disposed on opposite sides of the aeration chamber 18" at about halfway down the length of the aeration chamber 18'''. However, the aeration device 100''' can have fewer or more passages 20''' that can be located more proximally or more distally within the aeration chamber 18'''.

The end portion 50" can have a length 50*c*" of between about 10 mm and about 30 mm, more preferably about 20 mm. The cylindrical section 52" of the end portion 50" can have a length of between about 5 mm and about 20 mm, more preferably about 12 mm.

FIGS. 11A-11D show another embodiment of a diffuser element 200" for use with the aerator device 100'''. The diffuser element 200" is similar to the diffuser element 200 described above and can have the same features as the diffuser element 200, except as noted below. Thus, the reference numerals used to designate the various features of the diffuser element 200" are identical to those used for identifying the corresponding features of the diffuser element 200 in FIGS. 6A-6D, except that a "'" has been added to the reference numerals. Unless noted below, the description of the features of the diffuser element 200" is the same as the description of the corresponding features of the diffuser element 200 provides above.

The diffuser element 200" can have a base portion 210" and a top portion 220". The base portion 210" can have an outer shape that generally corresponds to the shape of the first chamber 16''' of the aerator device 100". In the illustrated embodiment, the base portion 210" is generally cylindrical. The top portion 220" can have one or more arms 222" that extend from the base portion 210" to a proximal end 200*a*" of the diffuser element 200". In the illustrated embodiment, the top portion 220" has four arms 222" that join each other at the proximal end 200*a*" so as to define a cross-shape. The arms 222" are arranged at 90° from each other, so as to define openings 224" between adjacent arms that communicate with a central passage 226" of the diffuser element 200" that extends from the top portion 220" to a distal opening.

The base portion 210" of the diffuser element 200" can have an outer diameter 210*a*" of about 10 mm. The base portion 210" can have a length 210*b*" of between about 5 mm and 10 mm, more preferably about 6 mm. The passage 226" of the diffuser element 200" can have an inner diameter 210*c*" of between about 4 mm and bout 9 mm, more preferably about 6 mm. The passage 226" can have a height of about 5 mm.

The top portion 220" of the diffuser element 200" can have an outer diameter 220*a*" of about 10 mm and an angle 210*c*" of about 2°. The diffuser element 200" can have a height of about 10-15 mm. Each of the arms 222" can have a width 222*a*" of between about 0.05 inches and about 0.1 inch. In one embodiment, the width 222*a*" can be about 0.08 inches. The arms 222" can have a lower width 222*b*" of about 2 mm and taper toward the proximal end 200*a*" at an angle of about 4°.

The diffuser element 200" can be coupled to the aerator device 100''' so that the diffuser element 200" at least partially extends into the first chamber 16'''. In one embodiment, the diffuser element 200" is press-fit into the first chamber 16'''. In one embodiment, the base portion 210" of the diffuser element 200" substantially completely extends into the first chamber 16''' so that the top portion 210" substantially completely extends into the cavity 14''' of the cup portion 10'''. Additionally, the inner diameter 210*c*" of the base portion 210" can be generally equal to the diameter 18*d*''' of the aeration chamber 18''' of the aerator device 100''', so that when the diffuser element 200" is coupled to the aerator device 100''' fluid flows between the cavity 14''' and the passage 32''' passes through a section of substantially constant diameter.

In use, a user can pour a fluid (e.g., wine) into the cavity 14''' of the cup portion 10''' of the aerator device 100'''. The fluid can then flow into the top portion 220" the diffuser device 200" and through the passage 226" into the aeration chamber 18''' of the aerator device 100'''. As the fluid flows into the aeration chamber 18''' it experiences a drop in pressure, which causes air to be drawn into the aeration chamber 18''' from outside the aerator device 100''' via the passages 20''' so that the air mixes with the fluid in the aeration chamber 18'''. The fluid then passes into the passage 32''' and out the distal end D''' of the aerator device 100". The top portion 220" of the diffuser device 200" advantageously inhibits the swirling of the fluid as it passes from the cavity 14''' into the aeration chamber 18''', so that that the fluid flows vertically through the aeration chamber 18''' thereby resulting in improved mixture of the fluid with the air that is drawn into the aeration chamber 18'''. In particular, the arms 222" of the top portion 220" of the diffuser element 200" counteract any swirling action of the fluid as it moves toward the diffuser 200" and guides the fluid flow into a substantially linear and vertical flow through the aeration chamber 18".

The aerator device 100, 100', 100", 100''' and diffuser element 200, 200', 200" can be made of a plastic material, such as PMMA. However, other suitable materials, such as hard plastics, can be used. In one embodiment, the aerator device 100, 100', 100", 100''' and diffuser element 200, 200', 200" are made of a transparent or translucent material.

Figure 12C:
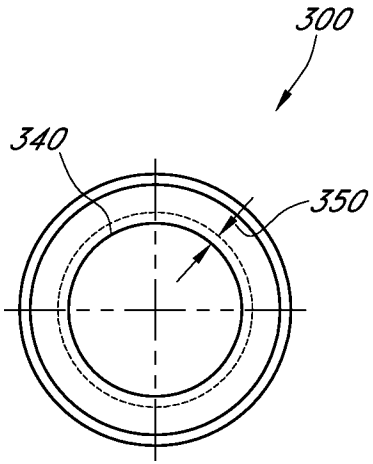
FIG. 12C is a schematic top view of the band of FIG. 12A.
Figure 12B:
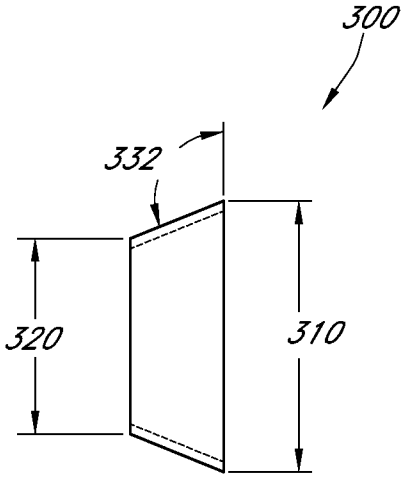
FIG. 12B is a schematic cross-sectional side view of the band of FIG. 12A.
Figure 12A:
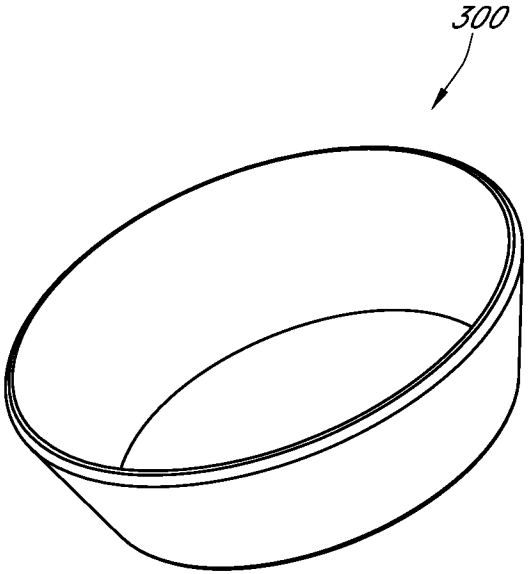
FIG. 12A is a schematic bottom view of one embodiment of a band for use with the aerator device of FIGS. 1, 7A, 9A and 10A.

FIGS. 12A-12C show one embodiment of a band 300 that can be positioned in the recessed section 12*d*, 12*d*', 12*d*", 12*d*''' of the aerator device 100, 100', 100", 100'''. The band 300 can have a proximal end diameter 310 of between about 1.5 inches and about 3 inches. In one embodiment, the proximal end diameter 310 can be about 2 inches. The band 300 can also have a distal end diameter 320 of between about 1 inch and about 2 inches. In one embodiment, the distal end diameter 320 can be about 1.5 inches. The band 300 can have a frustoconical shape, with an outer surface 330 that extends at an angle 332 of between about 90° and about 150°. In one embodiment, the angle 332 can be about 100°. The band 300 can have an inner diameter 340 at the distal end of between about 1 inch and about 1.5 inches, and more preferably about 1.3 inches. The thickness 350 of the band 300 can be between about 0.1 inches and about 0.3 inches, more preferably about 0.2 inches.

The band 300 can be made of an elastic material, such as rubber, and fit in the recessed section 12*d*, 12*d*', 12*d*", 12*d*''' so that the outer surface 330 of the band 300 is flush with the outer surface 12*c*, 12*c*', 12*c*", 12*c*''' of the cup portion 10, 10', 10", 10'''. Advantageously, the outer surface 330 of the band 300 provides a gripping surface, which may have a textured surface, to allow the user to hold the aerator device 100, 100', 100", 100''' while inhibiting the device from slipping from the user's grasp.

Figure 13C:
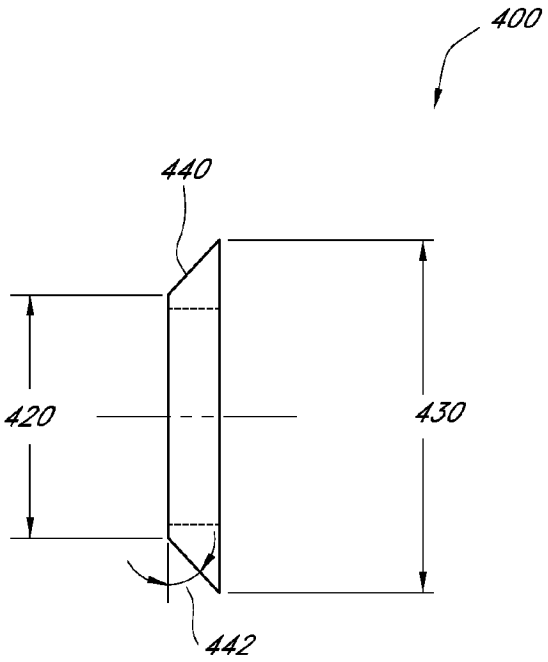
FIG. 13C is a schematic cross-sectional side view of the gasket of FIG. 13A.
Figure 13B:
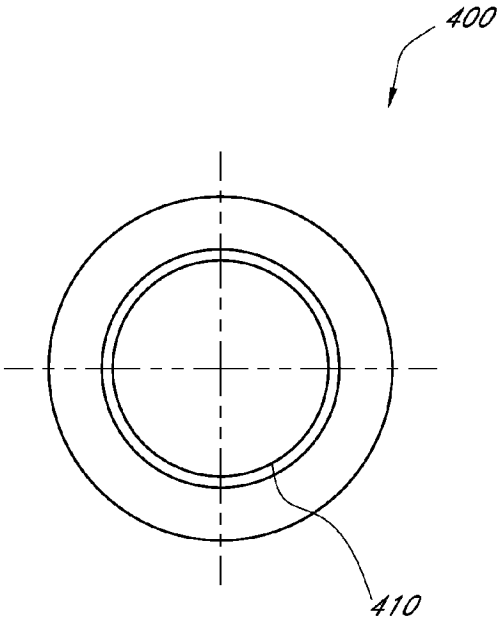
FIG. 13B is a schematic top view of the gasket of FIG. 13A.
Figure 13A:
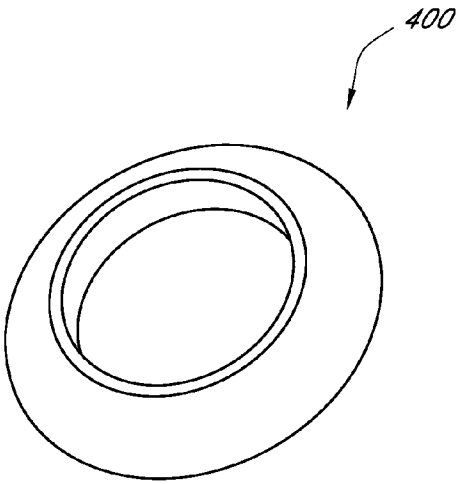
FIG. 13A is a schematic bottom view of one embodiment of a gasket for use with the aerator device of FIGS. 1, 7A, 9A and 10A.

FIGS. 13A-13C show one embodiment of a gasket 400 that can be used with the aerator device 100, 100', 100".

The gasket 400 can have a distal end diameter 420 of between about 0.5 inches and about 1 inch. In one embodiment, the distal end diameter 420 can be about ¾ inches. The gasket 400 can also have a proximal end diameter 430 of between about ¾ inch and about 2 inches. In one embodiment, the proximal end diameter 430 can be about 1 inch. The gasket 400 can have a frustoconical shape, with an outer surface 440 that extends at an angle 442 of between about 30° and about 50°. In one embodiment, the angle 442 can be about 40°. The gasket 400 can have an inner diameter 410 at the distal end of between about 0.5 inches and about 1 inch, and more preferably about 0.7 inches.

In use, a user can place the gasket 400 on an opening of a bottle, such as the opening of a wine bottle, so that the distal end 420 is adjacent the bottle opening, the user can then insert the end portion 50, 50', 50" of the aerator device 100, 100', 100" into the bottle opening so that the end portion 50, 50', 50" extends through the opening of the gasket 400. Advantageously, the gasket 400 supports the aerator device 100, 100', 100" on the bottle while a user pours wine back into the bottle via the aerator device 100, 100', 100", while the channels 56, 56', 56" allow air to escape from the bottle as the wine is poured in. Once the user is done pouring wine back into the bottle, the aerator device 100, 100', 100" and gasket 400 can be removed from the bottle.

Though the embodiments above are described in connection with aerating wine, one of ordinary skill in the art will recognize that aerator device 100, 100', 100" can be used to aerate any kind of fluid.

Of course, the foregoing description is that of certain features, aspects and advantages of the present invention, to which various changes and modifications can be made without departing from the spirit and scope of the present invention. Moreover, the aerator device need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed aerator device.

What is claimed is:

1. A device for aerating wine, comprising:

a cup portion having a cavity configured to receive an amount of wine therein, the cavity extending between a proximal opening at a proximal end of the cup portion and a distal opening at a distal section of the cavity, an intermediate portion that defines a generally cylindrical aeration section therein that is in fluid communication with the distal section of the cavity, the aeration section having one or more passages that extend laterally from the aeration section to an outer surface of the intermediate portion through which air is drawn into the aeration section, and an end portion, the intermediate and end portion defining a central passage in fluid communication with the aeration section and extending to a distal opening at a distal end of the end portion, the passage increasing in diameter from the aeration section toward a distal end of the end portion; and a diffuser element disposed in the distal section of the cavity and shaped to allow flow therethrough from the cavity to the aeration section, the diffuser element having an inner diameter that is generally equal to the diameter of the aeration section and having one or more arms that extend into the cavity.

2. The device of claim 1, wherein the distal section of the cavity is generally cylindrical and has a diameter greater than a diameter of the aeration section.

3. The device of claim 1, wherein the one or more arms of the diffuser element form a cross shape.

4. The device of claim 1, wherein the diffuser element is press-fit into the distal section of the cavity.

5. The device of claim 1, wherein the one or more passages in the aeration section comprises a pair of passages disposed on opposite sides of the aeration section.

6. The device of claim 5, wherein the one or more passages comprises four passages oriented at 90° to each other, two of the passages disposed on a different plane within the aeration section than a plane on which the other two passages are disposed.

7. The device of claim 1, wherein the central passage comprises a throat section, the diameter of the passage decreasing between the distal section of the cavity and the throat section, and the diameter of the passage increasing between the throat section and the distal end of the end portion.

8. The device of claim 1, further comprising an elastic band on an outer surface of the device, the elastic band comprising a surface having a texture configured to facilitate gripping of the device.

9. The device of claim 1, wherein the end portion has one or more channels on an outer surface thereof, the channels configured to allow air to flow out of a bottle in which the end portion has been at least partially inserted to allow wine to be poured into the bottle via the device.

10. A device for aerating a liquid, comprising:

a cup portion having a cavity configured to receive an amount of liquid therein, the cavity extending between a proximal opening at a proximal end of the cup portion and a distal opening at a distal section of the cavity, an intermediate portion that defines an aeration section therein that is in fluid communication with the distal section of the cavity, the aeration section having one or more passages that extend laterally from the aeration section to an outer surface of the intermediate portion through which air is drawn into the aeration section, and an end portion, the intermediate and end portion defining a conical passage in fluid communication with the aeration section and extending toward a distal opening at a distal end of the end portion, the passage increasing in diameter from the aeration section toward a distal end of the end portion; and a diffuser element disposed in the distal section of the cavity and shaped to allow flow therethrough from the cavity to the aeration section, the diffuser element having a plurality of arms that extend into the cavity and form a cross shape.

11. The device of claim 10, wherein the aeration section is generally cylindrical.

12. The device of claim 11, wherein the diffuser element has an inner diameter that is generally equal to the diameter of the aeration section.

13. The device of claim 10, wherein the distal section of the cavity is generally cylindrical and has a diameter greater than a diameter of the aeration section.

14. The device of claim 10, wherein the diffuser element is press-fit into the distal section of the cavity.

15. The device of claim 10, wherein the one or more passages in the aeration section comprises a pair of passages disposed on opposite sides of the aeration section.

16. The device of claim 15, wherein the one or more passages comprises four passages oriented at 90° to each other, two of the passages disposed on a different plane within the aeration section than a plane on which the other two passages are disposed.

17. The device of claim 10, wherein the central passage comprises a throat section, the diameter of the passage decreasing between the distal section of the cavity and the throat section, and the diameter of the passage increasing between the throat section and the distal end of the end portion.

18. The device of claim 10, further comprising an elastic band on an outer surface of the device, the elastic band comprising a surface having a texture configured to facilitate gripping of the device.

19. The device of claim 10, wherein the end portion has one or more channels on an outer surface thereof, the channels configured to allow air to flow out of a bottle in which the end portion has been at least partially inserted to allow wine to be poured into the bottle via the device.

20. A device for aerating wine, comprising:

a cup portion having a cavity configured to receive an amount of wine therein, the cavity extending between a proximal opening at a proximal end of the cup portion and a distal opening at a distal section of the cavity, an intermediate portion that defines an aeration section therein that is in fluid communication with the distal section of the cavity, the aeration section having one or more passages that extend laterally from the aeration section to an outer surface of the intermediate portion through which air is drawn into the aeration section, and an end portion, the intermediate and end portion defining a central passage in fluid communication with the aeration section and extending to a distal opening at a distal end of the end portion, the passage increasing in diameter from the aeration section toward a distal end of the end portion;

an elastic band on an outer surface of the device, the elastic band comprising a surface having a texture configured to facilitate gripping of the device; and a diffuser element disposed in the distal section of the cavity and shaped to allow flow therethrough from the cavity to the aeration section, the diffuser element having a plurality of arms that extend into the cavity.

21. The device of claim 20, wherein said diffuser element and cup portion are separate components, the diffuser element attachable to the cup portion.

* * * * *